US006139998A

United States Patent [19]

Mochizuki et al.

[11] Patent Number: 6,139,998

[45] Date of Patent: Oct. 31, 2000

[54] TRANSPARENT SUBSTRATE FOR AN ELECTROPHOTOGRAPHIC PHOTORECEPTOR AND AN ELECTROPHOTOGRAPHIC PHOTORECEPTOR USING THE SAME

[75] Inventors: Fumitaka Mochizuki; Kenichi Yasuda; Masao Asano, all of Hachioji, Japan

[73] Assignee: Konica Corporation, Japan

[21] Appl. No.: 09/271,663

[22] Filed: Mar. 17, 1999

[30] Foreign Application Priority Data

| | | | |
|---|---|---|---|
| Mar. 23, 1998 | [JP] | Japan | 10-074213 |
| Mar. 31, 1998 | [JP] | Japan | 10-086043 |
| Mar. 31, 1998 | [JP] | Japan | 10-086045 |
| Mar. 31, 1998 | [JP] | Japan | 10-086050 |

[51] Int. Cl.[7] ..... G03G 5/10

[52] U.S. Cl. ..... 430/56; 430/69

[58] Field of Search ..... 430/133, 134, 430/56, 69; 399/159

[56] References Cited

U.S. PATENT DOCUMENTS

| | | | |
|---|---|---|---|
| 5,708,930 | 1/1998 | Nagase et al. | 399/159 |
| 5,840,461 | 11/1998 | Haneda et al. | 430/134 |
| 5,935,749 | 8/1999 | Kawata et al. | 430/132 |

FOREIGN PATENT DOCUMENTS

| | | |
|---|---|---|
| 8202067 | 8/1996 | Japan . |

*Primary Examiner*—John Goodrow

*Attorney, Agent, or Firm*—Jordan B. Bierman; Bierman, Muserlian and Lucas

[57] ABSTRACT

A transparent substrate for the electrophotographic photoreceptor is disclosed. The substrate is cylindrical and made of a polymer resin, and Rz of an inner surface of the cylindrical substrate is not more than 0.5 $\mu$m. The electrophotographic photoreceptor employing the substrate is suitably used for imagewise exposure of the electrophotographic photoreceptor from the inside of the cylindrical substrate. An image forming method employing the photoreceptor is also disclosed.

13 Claims, 4 Drawing Sheets

$$R_z = \frac{(n_1 \cdot \cdot \cdot \cdot + n_5) - (n'_1 \cdot \cdot \cdot \cdot + n'_5)}{5}$$

TRANSPARENT SUBSTRATE FOR AN ELECTROPHOTOGRAPHIC PHOTORECEPTOR AND AN ELECTROPHOTOGRAPHIC PHOTORECEPTOR USING THE SAME

FIELD OF THE INVENTION

The present invention relates to a transparent substrate for an electrophotographic photoreceptor, which is employed in monochromatic and color copiers, monochromatic and color printers, and the like, and an electrophotographic photoreceptor using the same.

In an image forming apparatus employing an electrophotographic system, the surface of an electrostatic image forming body which is in the form of a rotating drum or belt, is charged; is exposed imagewise, and is developed to form a toner image on the electrostatic image forming body, which is transferred subsequently to a transfer material, and then fixed. In order to achieve these function, the electrostatic image forming body should move at a constant speed under predetermined timing so that the distance and contact pressure situation between the image forming body and each of the charging device, the exposure device, the development device, the transfer device, the charge eliminating device, the cleaning device, etc., which are arranged around the image forming body, are not changed. Furthermore, for repeated use, after each device finishes its function during one image forming cycle, each device should return to the initial position so as to be ready for the subsequent cycle. In order to smoothly achieve a series of these functions and to further efficiently utilize costly members such as photoreceptors, etc., in a practical apparatus, as the photoreceptor, a photoreceptor drum is employed, which is prepared by providing a photosensitive layer on the circumferential surface of an almost cylindrical substrate. As the material of the cylindrical substrate, metals such as aluminum, etc. are employed in most cases. However, in terms of cost reduction, the limit has been reached when the cylindrical substrate is produced by machining, employing metals.

On the other hand, because plastics (polymer resins) are light in weight and low in cost, as the material of the photoreceptor substrate, these are considered to be preferred materials.

In a color image forming apparatus employing an electrophotographic system, a type of apparatus, in which exposure is carried out from the inner side of a photoreceptor through a transparent cylindrical substrate is excellent because this type of apparatus is considered to be appropriate for obtaining high quality color image at a high speed and a compact image forming apparatus.

With the image forming apparatus in which exposure is carried out from the inside of the electrophotographic photoreceptor, it is important that the cylindrical substrate of the photoreceptor is transparent to light and exhibits optical uniformity. Therefore, more excellent transparent base bodies for the image forming apparatus are being demanded. Japanese Patent Publication Open to Public Inspection No. 8-202067 proposes a method which produces a transparent and accurate substrate employing a synthetic resin being light in weight with excellent shock resistance, and low in cost.

However, characteristics of current transparent substrate are still not sufficient for the use of an image forming apparatus in which exposure is carried out from the inside of the electrophotographic photoreceptor. Sometimes clear image has not been obtained due to image blur or uneven image density particularly. Further peeling off of photoconductive layer occurred in case that the photosensitive layer was coated on the substrate.

In addition to the above, because the circumference of a photoreceptor is subjected to thermal effect from the exposure lamp, thermal fixing device, etc., plastics, which are employed to produce a photoreceptor substrate, preferably have thermal resistance, including flame resistance or incombustibility.

SUMMARY OF THE INVENTION

An object of the present invention is to provide a transparent substrate for an electrophotographic photoreceptor, which, when an image is exposed through its photoreceptor substrate, minimizes image blur and image distortion, and exhibits good adhesion of the electrically conductive layer with the substrate, excellent resolving power, and durability of the finished image, and to provide a production method thereof, and an electrophotographic photoreceptor, an image forming method, and an image forming apparatus using the same.

Another object of the present invention is to provide a transparent substrate for an electrophotographic photoreceptor, which exhibits high transparency without optical distortion, high humidity and heat resistance, minimum deformation of the substrate, excellent dimensional stability, and results in no deterioration of electrophotographic performance and image quality when repeatedly employed, and a production method thereof, and to provide an electrophotographic photoreceptor, an image forming method, and an image forming apparatus using the same.

Still another object of the present invention is to provide a transparent substrate for an electrophotographic photoreceptor, which exhibits high transparency without optical distortion, minimum deformation of the substrate, excellent dimensional stability, and results in no deterioration of electrophotographic performances when repeatedly employed, and in addition, exhibits high incombustibility, and a production method thereof, and to provide an electrophotographic photoreceptor, an image forming method, and an image forming apparatus using the same.

The present invention and embodiment thereof are described below.

The transparent substrate for the electrophotographic photoreceptor of the present invention is cylindrical and made of a polymer resin, and the Rz of the inner surface is not more than 0.5 $\mu$m.

The Rz of the outer surface of the cylindrical transparent substrate is preferably between 0.2 and 2.0 $\mu$m.

Polymer resins are preferably vinyl series polymer resins.

The waviness of the inner surface of the cylindrical transparent substrate is preferably between 0.1 and 5.0 $\mu$m.

The transparent substrate is preferably formed employing a polymer resin obtained by copolymerizing radical polymerizable monomers using a multifunctional vinyl compound as a cross-linking agent.

The above-mentioned radical polymerizable monomer is preferably methyl methacrylate.

In the transparent substrate for an electrophotographic photoreceptor, the transparent substrate is formed employing a cross-linked polymer resin and the double refraction of the aforesaid transparent substrate is not more than 150 nm and the difference in the substrate is preferably within 50 nm.

The transparent substrate is preferably formed of a polymer resin containing a fire-retardant.

The transparent substrate is preferably formed of a polymer resin obtained by a centrifugal polymerization method.

An electrophotographic photoreceptor may be obtained by providing an electrically conductive layer and a photosensitive layer onto the transparent substrate.

The present electrophotographic photoreceptor may be suitably employed for the use of exposure from inside of the cylindrical substrate in which an exposure light source is provided in the inside of the cylinder forming the transparent substrate, and from this light source. The photosensitive layer is provided on the outer surface of the cylinder which is subjected to image exposure through the substrate.

The surface of the electrophotographic photoreceptor is uniformly charged, and is exposed imagewise and development is repeatedly carried out with each toner having different color to form superimposed multicolor images which are simultaneously transferred, separated, fixed, and the photoreceptor is cleaned. After finishing these processes, in the image forming apparatus to form images, the substrate is exposed imagewise from the inside of the cylinder of the transparent substrate and may be employed as an image forming apparatus for forming images.

Herein, so-called non-contact development is preferably carried out.

DETAILED DESCRIPTION OF THE INVENTION

As described above, Japanese Patent Publication Open to Public Inspection No. 8-202067 (employing a centrifugal polymerization method) proposes a production method in which a substrate, which is transparent, dimensionally stable, light in weight, and excellent in shock resistance, is produced employing low cost synthetic resins. As such resin, methacrylic acid ester resin and the like are employed, and production and machining are easily carried out and the cost is low. It may certainly be considered as an epoch-making departure, compared with the conventional method. However, the inventors of the present invention have checked the patent and have found that when a photosensitive layer is coated during production of the photoreceptor, the unacceptable surface roughness of the substrate which occurs occasionally causes image blur, uneven density, etc. and it is difficult to obtain clear and sharp images. In order to minimize scattering of image exposure light, without increasing production costs, and to still obtain high image quality, the Rz of the inner surface is preferably between 0.01 and 0.5 $\mu$m.

The Rz of the outer surface of a transparent substrate is preferably between 0.2 and 2.0 $\mu$m in order to obtain preferred adhesive properties of the layer, e.g. electrically conductive layer, provided on the transparent substrate, to minimize the deterioration of discharge properties of charges during image formation on many sheets, the degrade of image quality and layer peeling, and to obtain sufficient focusing properties and high resolving power and to minimize image blur.

Figure 1:
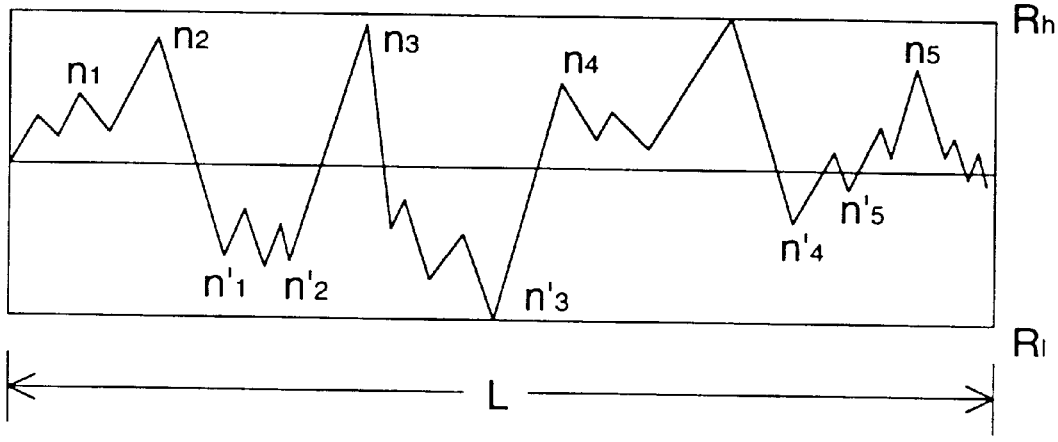
FIG. 1 is a diagram describing Rz.

Furthermore, the surface roughness Rz in the present invention is represented as follows and as described in FIG. 1. Rz (average roughness at 10 points)

Difference between the average height of five summits and the average depth of five valleys, within length L In order to control the Rz of the outer surface of the transparent substrate between 0.2 and 2.0 $\mu$m as shown in the present invention, though not particularly limited to these values, for example, a metal mold for the centrifugal polymerization having an Rz within the above-mentioned range is employed or after production, a product may be polished or cut so as to fall into the above-mentioned range.

For instance, in order to adjust the Rz of the inner surface to not more than 0.5 $\mu$m, rotation frequency at centrifugal polymerization may be increased, and adjustments may be carried out during the production process, such as the viscosity of the resin solution, polymerization time, etc. or post-processing such as polishing.

Generally speaking, the presence of undulation on the inner surface of the transparent substrate shows that there are internal stress and non-uniform portions. Due to that, when undulation component becomes not less than 0.5 $\mu$m, it should be avoided because keeping quality of the photoreceptor over an extended period of time and mechanical stability of the photoreceptor may be deteriorated. However, in terms of cost, it is not advantageous to decrease the undulation to not more than 0.1 $\mu$m.

Further, the degree of the undulation is represented by $W_{CM}$ in standard length 0.25 mm of JIS.

Furthermore, the transparent substrate for the electrophotographic photoreceptor in the present invention is produced employing a centrifugal polymerization method, injection molding, extrusion molding, etc. Production employing the centrifugal polymerization method as the representative method is specifically illustrated as in FIG. 2. FIG. 3 illustrates one example of the production apparatus. In the production apparatus of FIG. 3, C1 is a cylindrical mold and the inner surface is polished to form a cylindrical surface of high accuracy. C2 is a heating member and heats the mold C1 from the outside. C3 is a mold securing member and clamps the mold C1 from both the right and left and under the clamped state, liquid in the inside of the mold C1 is arranged so as to be not leaked. C4 is an injection inlet to which polymerizable liquid materials are poured. C5 is a thermometer which measures the inside temperature of C1. This apparatus is structured so that the axis of the mold C1 operates in a horizontal plane and after the polymerizable liquid material is poured, is rotated high speed. Further, after molding the mold, a cylindrical substrate is taken out by moving one side mold securing as shown by arrow B.

Figure 2:
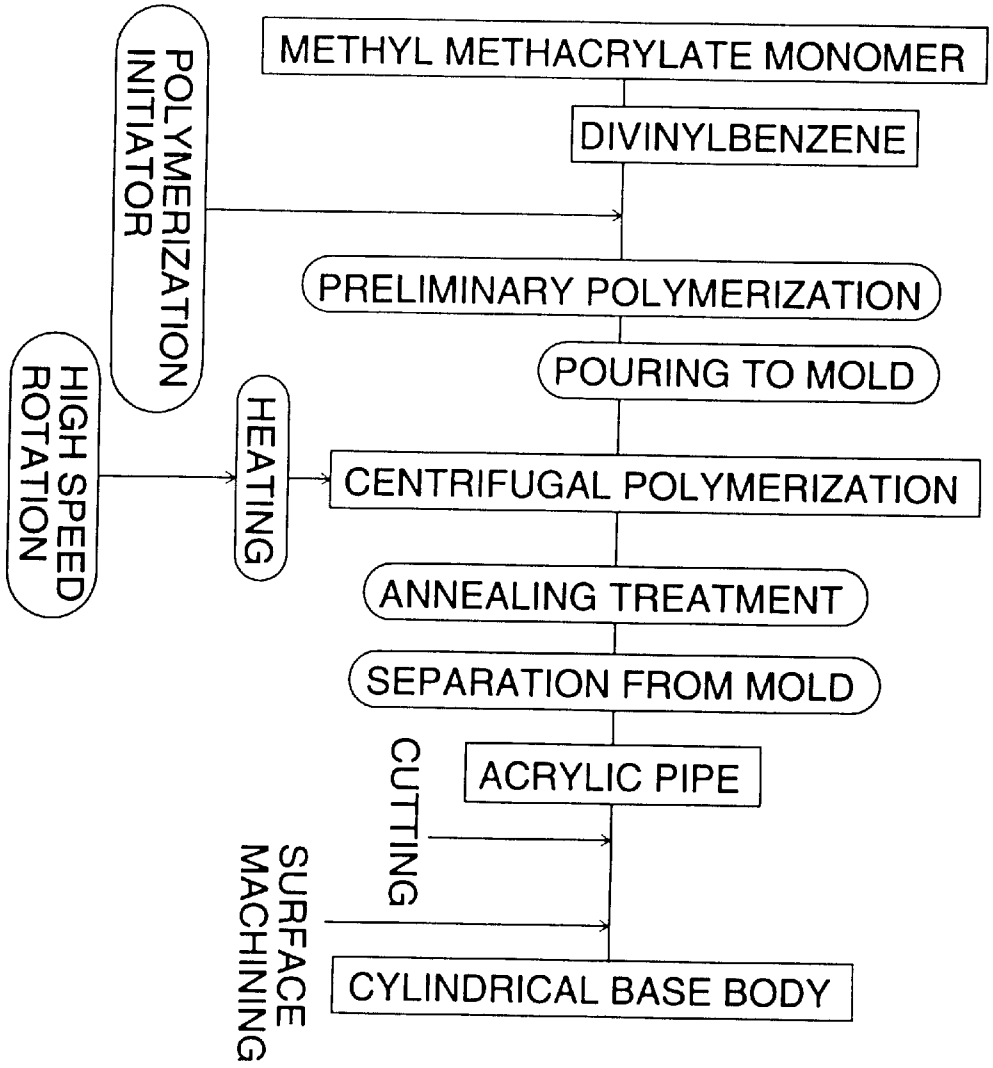
FIG. 2 is a flow diagram of a production method of the transparent substrate for an electrophotographic photoreceptor of the present invention.
Figure 3:
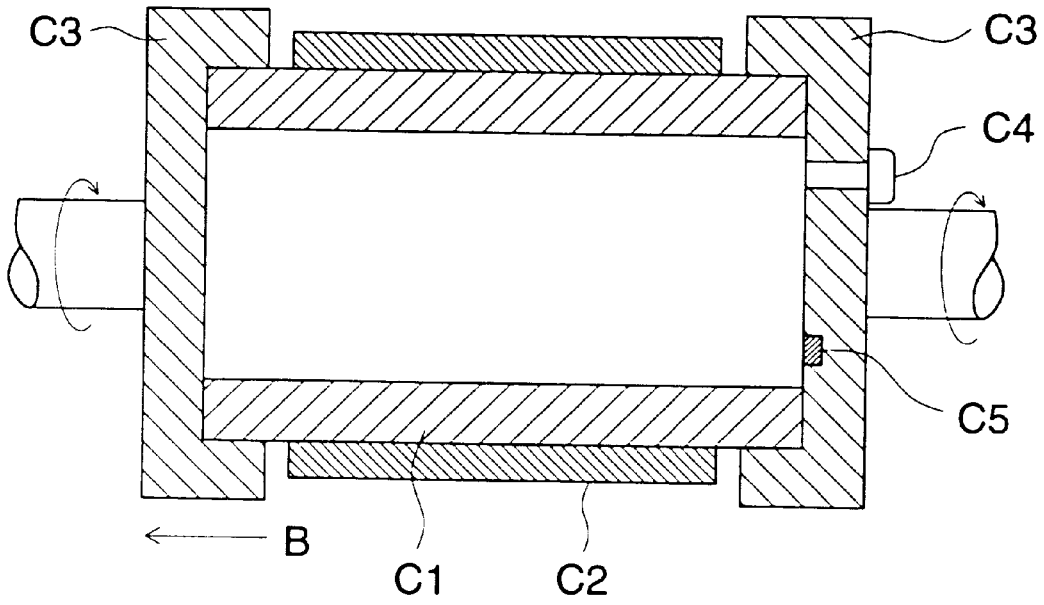
FIG. 3 is a sectional view showing one example of a production apparatus.

In the production process shown in FIG. 2, initially, vinyl polymerizable liquid materials in which, for example, methacrylic acid methyl ester monomers are employed as radical polymerizable monomers, and divinylbenzene as a multifunctional vinyl compound and azoisobutylonitrile as a polymerization initiator are added, are subjected to preliminary polymerization under a viscosity between 10 and 400 cp, and are poured into a cylindrical mold C1, which generally has an inner diameter between 20 and 200 mm and a length between 200 and 2,000 mm. Uniform polymerization is enhanced by proper heating while rotating the entire mold. After completing the polymerization, the resulting product is annealed and is cooled to near room temperature, and the formed substrate is taken out from the mold, and is cut and is subjected to a surface treatment process, if desired, to complete the production of the transparent substrate for an electrophotographic photoreceptor.

The above-mentioned centrifugal polymerization method preferably employed in the present invention leaves no die scar on the surface of the cylindrical substrate, and particularly, the inner surface is formed as a natural surface obtained by a centrifugal force, and an extremely smooth inner surface like a glass surface is formed.

The substrate of the present invention may be obtained by polymerizing or copolymerizing radical polymerizable monomers (monomers which are monomers having no cross-linking properties) or a multifunctional vinyl compound (a monomer having cross-linking properties) in the presence of a radical polymerization initiator. However, in terms of heat resistance, solvent resistance and dimensional stability, cross-linking is preferably carried out.

The preferred materials to produce the substrate of the present invention may be obtained by copolymerizing radical polymerizable monomers with multifunctional vinyl compounds (cross-linking monomers) in the presence of a radical polymerization initiator.

Detailed description is given below.

Employed as radical polymerizable monomers used in the present invention, are side chain alkyl-substituted styrenes such as styrene, a-methylstyrene, m-methylstyrene, p-methylstyrene, etc.; nucleus alkyl-substituted styrenes such as vinyltoluene, etc.; halogenated styrenes such as p-chlorostyrene, o-chlorostyrene, m-chlorostyrene, p-bromostyrene, o-bromostyrene, m-bromostyrene, 2,4-dichlorostyrene, 2,4-bromostyrene, 4-chloro-α-methylstyrene, 4-bromo-α-methylstyrene, 2,4,6-trichlorostyrene, 2,4,6-tribromostyrene, pentachlorostyrene, pentabromostyrene, etc.; aromatic vinyl series monomers such as vinyl benzoate, 2-vinylnaphthalene, 4-vinylphenyl, 1,1'-diphenylethylene, etc.; cyanated vinyl series monomers such as acrylonitrile, methacrylonitrile, fumaronitrile, maleonitrile, α-chloroacrylonitrile, etc.; methacrylic acid alkyl esters, and acrylic acid alkyl esters such as methyl methacrylate, ethyl methacrylate, propyl methacrylate, isopropyl methacrylate, butyl methacrylate, amyl methacrylate, hexyl methacrylate, 2-ethyl methacrylate, nonyl methacrylate, dodecyl methacrylate, octadecyl methacrylate, stearyl methacrylate, octyl methacrylate, cyclohexyl methacrylate, allyl methacrylate, dicyclopentanyl methacrylate, norbornyl methacrylate, adamantyl methacrylate, isobolnyl methacrylate, phenoxyethyl methacrylate, phenyl methacrylate, benzyl methacrylate, naphthyl methacrylate, butoxyethyl methacrylate, methyl acrylate, ethyl acrylate, propyl acrylate, butyl acrylate, amyl acrylate, hexyl acrylate, octyl acrylate, stearyl acrylate, 2-ethylhexyl acrylate, cyclohexyl acrylate, dodecyl acrylate, phenyl acrylate, benzyl acrylate, etc.; methacrylic acids and acrylic acids such as methacrylic acid, acrylic acid, etc.; OH group containing methacrylates and OH group containing methacrylates such as 2-hydroxyethyl methacrylate, 2-hydroxyethyl acrylate, propyl methacrylate, propyl acrylate, 2-hydroxy-3-phenoxypropyl methacrylate, propyl methacrylate, propyl acrylate, 2-hydroxy-3-phenoxypropyl acrylate, tetrahydrofulfuryl methacrylate, 2-hydroxy-3-phenoxypropyl acrylate, tetrahydrofulfuryl acrylate, etc.; epoxy group containing methacrylates and epoxy group containing acrylates such as glycidyl methacrylate, glycidyl acrylate, etc.; N containing methacrylates and N containing acrylates such as N,N-diethylaminoetyl methacrylate and N,N-diethylaminoethyl methacrylate, etc.; ether group containing methacrylates and ether group containing acrylates such as butoxytriethylene glycol methacrylate, butoxytriethylene glycol acrylate, ethoxydiethylene glycol methacrylate, ethoxydiethylene glycol methacrylate, etc.; maleic acid esters such as maleic acid, maleic acid anhydride, dimethyl maleate, dibutyl maleate, dibenzyl maleate, etc.; itaconic acid esters such as itaconic acid, itaconic acid anhydride, benzyl itaconate, dibenzyl itaconate, etc.; fumaric acid and fumaric acid esters such as fumaric acid, dimethyl fumarate, dibutyl fumarate, diisopropyl fumarate, dibenzyl fumarate, dicyclohexyl fumarate, etc.; as the other monomers, vinyl acetate, vinyl chloride, vinylidene chloride, N-alkylmaleimides, N-phenylmaleimides and mixtures thereof. More preferably, of radical polymerizable monomers, methacrylate is contained preferably in an amount of not less than 20 weight percent, and more preferably in an amount of 40 weight percent.

In order to increase Rockwell hardness to not less than 80, listed as those most preferred are polyester resins, polyphenylene sulfide resins, polycarbonate resins, polysulfone resins, methacrylic series resins, acrylic series resins, styrene series resins, etc.

As multifunctional vinyl compounds (monomers having cross-linking properties), at least one selected from those described below is employed as a cross-linking agent; divinylbenzene, methadivinylbenzene, 4,4'-divinylbiphenyl, 3,3'-divinylbiphenyl, 3,4'-divinylbiphenyl, ethylene glycol methacrylate, ethylene glycol acrylate, diethylene glycol methacrylate, diethylene glycol acrylate, 1,4-butanediol methacrylate, 1,4-butanediol acrylate, trimethylolpropane trimethacrylate, trimethylolpropane triacrylate, pentaerythritol tetramethacrylate, pentaerythritol tetracrylate, divinyl phthalate, diallyl phthalate, divinyl isophthalate, diallyl isophthalate, divinyl terephthalate, diallyl terephthalate, diallyl naphthenate, triallyl isocyanurate, diallyl carbonate, diethylene glycol bisallylcarbonate. The employed addition amount of the cross-linking agents is in the range of 0.05 to 90 weight percent of all monomers (radical polymerizable monomers+ multifunctional vinyl compounds) in raw materials. When the addition amount is less than 0.05 weight percent, heat resistance is not satisfied. When the addition amount is not less than 90 weight percent, mechanical durability is degraded due to the formation of a hard but brittle polymer resin.

There is no particular limitation on radical polymerization initiators which are employed during polymerization of the polymer resin for the substrate employed in the present invention and those are acceptable, which generate active radicals when applied by active energy rays such as visible light, infrared ray, ultraviolet ray, microwave, electron ray, etc. or heat.

Radical polymerization initiators, which generate active radicals in the presence of heat, include benzoyl peroxide, diisopropylperoxydicarbonate, t-butylperoxy-2-ethyl hexanoate, t-butylperoxypivalate, t-butylperoxydiisobutylate, lauroyl peroxide, t-butylperoxyacetate, t-butylperoxyoctoate, t-butylperoxybenzoate, di-t-butyl peroxide, azobisisobutylonitrile, etc.

Radical polymerization initiators, which generate active radicals in the presence of the active energy rays, include acetophenone, benzophenone, benzoin, benzoin methyl ether, 2-hydroxy-2-methyl-1-phenylpropane-1-on, hydroxycyclohexyl phenyl ketone, methylphenylglyoxylate, 2,4,6-trimethylbenzoyldiphenyl, which can be employed individually or in combination.

The mixing ratio of the above-mentioned radical polymerization initiators varies depending on the types of radical polymerization initiators, the types of vinyl series monomers, the polymerization hardening temperature, etc. Generally, however, 0.01 to 8 parts by weight to 100 parts by weight of copolymerizable vinyl series monomer is preferred, and 0.1 to 5 parts by weight are particularly preferred. The mixing ratio of the above-mentioned radical polymerization initiators of less than 0.01 part by weight is not preferred because polymerization hardening takes a long time or the polymerization is at times not even completed. The mixing ratio of the polymerization initiators of not less than 8 parts by weight is not preferred because the resulting polymer becomes brittle or is colored.

Furthermore, polymers other than the vinyl series polymers, which constitute the base of the present invention, include polyamides, polyimidos, epoxy resins, polycarbonates, polysulfones, polyethersulfones, polyesters, polyarylates, polyphenylene oxides, polybutylene terephthalates, polyethylene terephthalates, polymetylpentens, etc. After injection-molding or extrusion-molding of these polymers, the transparent cylindrical substrate of the present invention may be produced by obtaining the desired Rz through polishing or machining the surface.

Furthermore, vinyl series polymers which are not cross-linked may be used as substrate materials employing the above-mentioned molding method.

The substrate itself is preferred to be optically uniform. Low double refraction and minimum difference among portions of the substrate are preferred. In practice, no problem is caused regarding optical uniformity and no anisortopic portions are produced. The substrate is preferred which has a double refraction of not more than 150 nm or has a difference due to portions of not more than 50 nm. More preferably, the double refraction is to be not more than 100 nm, and the dispersion is to be 20 nm, and most preferably, the double refraction is to be not more than 30 nm, and the dispersion is to be not more than 10 nm.

The double refraction is adjusted through the selection of monomers, further, polymerization conditions, e.g. temperature during polymerization, stirring conditions, time management, and adjustment of residual stress decrease due to molecular orientation in the annealing process.

The double refraction can be measured by employing well known methods with the use of an Abbe's refractometer, a strain meter (for example, Accurate Distortion Meter SVP-30 manufactured by Toshiba Corp.), an ellipsometer, etc. Measurement may be carried out so that the maximum and minimum values are found from all positions of the photoreceptor substrate. In practice, measurements are carried out for positions at the central part of the substrate and at both ends, which are involved in image formation.

When incombustible materials are used, a substrate can be obtained by copolymerizing a radical polymerizable monomer, a multifunctional vinyl compound, and a fire-retardant in the presence of a radical polymerization initiator.

Listed as the fire-retardants employed in the present invention, are various types of compounds containing elements such as P, halogens, N, S, Sb, B, etc. These may be employed individually or in combinations of at least two of those listed.

Specific examples of inorganic series fire-retardants include compounds containing antimony such as antimony trioxide, antimony tetraoxide, antimony pentaoxide, antimonic acid soda, etc., alumina hydrate, magnesium hydroxide, zinc borate, barium borate, etc. Generally, inorganic series compounds tend to decrease light transmission and ultra-fine particle type or organic solvent-soluble types, etc. are preferred. However, organic series fire-retardants are more preferred in terms of incombustible effects.

Specific examples of halogen series fire-retardants include, for example, chlorinated paraffin, chlorinated polyolefin, chlorinated polyethylene, chlorinated polyphenyl, chlorinated oil, perchlorocyclopentadecane, hexabromobenzene, decabromodiphenyl oxide, octabromodiphenyl oxide, pentabromodiphenyl oxide, polydibromophenylene oxide, bis(tribromophenoxy)ethane, ethylenebis-dibromonorubornanedicarboxyimide, dibromoneopentyl glycol tetracarbonate, brominated bisphenol series carbonate oligomer, brominated bisphenol series epoxy resin, brominated bisphenol series phenoxy resin, brominated polystyrene, tetrachlorophthalic anhydride, tetrabromophthalic anhydride, ethylenebis-tetrabromophthalimide, bis(tribromophenyl)fumalamide, N-methylhexabromophenylamine, dibromoethyl, dibromocyclohexane, dibromoneopentyl glycol, tribromophenol, pentabromophenol, hexabromocyclododecane, hexabromodiphenyl ether, decabromodiphenyl ether, tribromophenol allyl ether, tetradecabromodiphenoxybenzene, 2,2-bis(4-hydroxy-3,5-dibromophenyl)propane, tetrabromobisphenol A, tetrabromobisphenol S, tris-(2,3-dibromopropyl-1)-isocyanurate, 2,2-bis(4-(2,3-dibromoproxy)-3,5-dibromophenyl)propane, brominated epoxy, brominated long chain glyceride.

As phosphorus series fire-retardants, there are triarylphosphoric acid esters, diarylphosphoric acid esters, monoarylphosphoric acid esters, arylphosphonic acid compounds, arylphosphone oxide compounds, condensed arylphosphoric acid esters, etc. In more detail, specific examples of fire-retardants containing a phosphorous atom include butyl pyrophosphate, butyl acid phosphate, butoxyethyl acid phosphate, 2-ethylhexyl acid phosphate, guanylurea phosphate, guanidine phosphate, trimethyl phosphate, tributyl phosphate, trioctyl phosphate, tributoxyethyl phosphate, triphenyl phosphate, diphenyloctyl phosphate, triallyl phosphate, tricresyl phosphate, cresyldi-2,6-xylenyl phosphate, diphenylcresyl phosphate, diethylbis(hydroxyethyl)aminomethyl phosphate, tris(3-hydroxypropyl)phosphine oxide, dibutylhydroxymethyl phosphonate, di(butoxy)phosphinyl-propylamide, dimetylmethyl phosphonate, aromatic condensed phosphoric acid esters, for example, CR-7335, CR-741, CR-747, RX-200 (these manufactured by Daihachi Kagaku Kogyo Co.), etc. There are listed di-(polyoxyethylene)-hydroxymethylphosphonate, 9,10-dihydro-9-oxtha-10-phosphaphenanthrene-10-oxide, phenyl phosphonic acid, phosphorous-containing polyols, aromatic polyphosphates, melamine phosphoric acid salts, polyphosphoric acid ammonium, etc., and they are employed individually or in combinations of two or more. Because phosphorous containing series fire-retardants contain no halogen, they are preferred as materials friendly to the circumstance.

Halogen containing phosphoric acid ester series fire-retardants contain halogen atoms such as chlorine or bromine in the structural unit of phosphate, polyphosphate, polyphosphonate, which include halogenated alkyl phosphoric acid esters, halogen-containing condensed phosphoric acid esters, for example, CR-380, CR-387, CR-530 (these manufactured by Daihachi Kagaku Kogyo Co.), etc. There are halogen containing condensed phosphonic acid esters, halogen containing phosphorous acid esters, etc. Listed as specific examples are chlorophosphate, bromophosphate, trischloroethyl phosphate, dibromopropyl phosphate, trischloropropyl phosphate, tri(2,3-dibromopropyl)phosphate, bis(2,3-dibromopropyl)2,3-dichloropropyl phosphate, bis(chloropropyl)octyl phosphate, tris(β-chloroethyl)phosphate, tris(dichloropropyl)phosphate, tris(tribromoneopentyl) phosphate, tris(2,4,6-tribromophenyl)phosphate, bischloroethyl dichloropropyl phosphate, halogenated alkylpolyphosphate, halogenated alkylpolyphosphate, etc. and halogen atom containing phosphoric acid esters having a phosphoric acid ester structure represented by general formula (1) described below are preferred.

General formula (1)

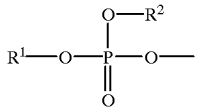

wherein $R^1$ and $R^2$ each represents a monovalent hydrocarbon group which may contain a halogen atom, a phosphorous atom, or an oxygen atom, or a hydrogen atom, or represents a divalent hydrocarbon group formed by the combination of both, which may contain a halogen atom, a phosphorous atom, or an oxygen atom.

In the above general formula (1), $R^1$ and $R^2$ each represents a monovalent hydrocarbon group which may contain a halogen atom, a phosphorous atom, or an oxygen atom, or a hydrogen atom, or represents a divalent hydrocarbon group formed by the combination of both, which may contain a halogen atom, a phosphorous atom, or an oxygen atom. Herein, the monovalent hydrocarbon group which may contain a halogen atom, a phosphorous atom, or an oxygen atom, or a hydrogen atom are preferably a halogenoalkyl group having from 1 to 20 carbon atoms such as chloromethyl, chloroethyl, chloropropyl, tribromoneopentyl, etc.; a halogenoaryl group having from 6 to 20 carbon atoms such as dibromophenyl, 2,4,6-tribromophenyl, dichlorophenyl, 2,4,6-trichlorophenyl, etc.; a halogenoaralkyl group having from 7 to 20 carbon atoms; a [bis(halogenoalkoxy)phosphinyl] alkyl group having from 3 to 20 carbon atoms such as 1-[bis(2-chloroethoxy) phosphinyl]-1-methylethyl; an alkyl group having from 1 to 20 carbon atoms such as methyl, ethyl, propyl, neopentyl, etc.; an aryl group having from 6 to 20 carbon atoms such as phenyl; those having from 1 to 20 carbon atoms such as an aralkyl group from 7 to 20 carbon atoms such as benzyl, phenetyl, etc. Furthermore, the divalent hydrocarbon groups formed by the combination of $R^1$ and $R^2$, which may contain a halogen atom, a phosphorous atom, or an oxygen atom are preferably represented by general formula (2):

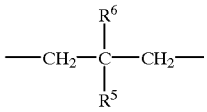

Wherein $R^5$ and $R^6$ each represents a monovalent hydrocarbon group which may contain a halogen atom, or a hydrogen atom.

The monovalent hydrocarbon groups represented by $R^5$ and $R^6$ which may contain a halogen atom are preferably a halogenoalkyl, halogenoaralkyl, alkyl, aryl or aralkyl group having from 1 to 20 carbon atoms previously exemplified in $R^1$ and $R^2$.

Phosphoric acid esters which are represented by general formulas (2) through (6) described below are preferred.

The general formula (2) is described below.

General formula (2)

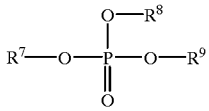

wherein $R^7$ represents a monovalent hydrocarbon group which may contain a halogen atom or a hydrogen atom, and $R^8$ and $R^9$ each represents a monovalent hydrocarbon group which may contain a halogen atom or a hydrogen atom, or represents a divalent hydrocarbon group formed by the combination of both, which may contain a halogen atom. However, in the definition described above, at least one of $R^7$, $R^8$, and $R^9$ is a divalent hydrocarbon group having a halogen atom, which is formed individually or in combination.

The general formula (3) is described below.

General formula (3)

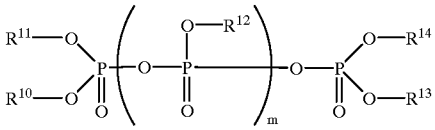

wherein $R^{10}$ and $R^{11}$ each represents a monovalent hydrocarbon group which may contain a halogen atom or a hydrogen atom, or represents a divalent hydrocarbon group formed by the combination of both, which may contain a halogen atom; $R^{12}$ represents a monovalent hydrocarbon group which may contain a halogen atom or a hydrogen atom, and $R^{13}$ and $R^{14}$ each represents a monovalent hydrocarbon group which may contain a halogen atom or a hydrogen atom, or represents a divalent hydrocarbon group formed by the combination of both, which may have a halogen atom. However, in the definition described above, at least one of $R^{10}$, $R^{11}$, $R^{12}$, and $R^{14}$ is a monovalent or divalent hydrocarbon group having a halogen atom, which is formed individually or in combination and "m" represents an integer of 0 to 5.

Compounds represented by general formula (4) are those described below.

General formula (4)

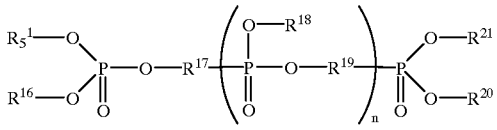

wherein $R^{15}$ and $R^{16}$ each represents a monovalent hydrocarbon group which may contain a halogen atom or a hydrogen atom, or represents a divalent hydrocarbon group formed by the combination of both, which may contain a halogen atom; $R^{17}$ and $R^{19}$ each represents a divalent hydrocarbon group which may have a halogen atom; $R^{18}$ represents a monovalent hydrocarbon group which may contain a halogen atom or a hydrogen atom, and $R^{20}$ and $R^{21}$ each represents a monovalent hydrocarbon group which may contain a halogen atom or a hydrogen atom, or represents a divalent hydrocarbon group formed by the combination of both, which may have a halogen atom. "n" represents an integer of 0 to 5.

Compounds represented by general formula (5) are those described below.

General formula (5)

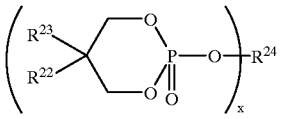

wherein $R^{22}$ and $R^{23}$ each represents a monovalent hydrocarbon group which may contain a halogen atom or a hydrogen atom, and $R^{24}$ represents an x-valent hydrocarbon group which may contain a halogen atom. "x" represents an integer of 2 to 5.

Compounds represented by general formula (6) are those described below.

General formula (6)

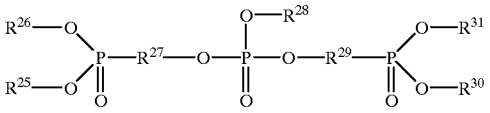

wherein $R^{25}$ and $R^{26}$ each represents a monovalent hydrocarbon group which may contain a halogen atom or a hydrogen atom, or represents a divalent hydrocarbon group formed by the combination of both, which may contain a halogen atom; $R^{27}$ and $R^{29}$ each represents a divalent hydrocarbon group which may have a halogen atom or a hydrogen atom; $R^{28}$ represents a monovalent hydrocarbon group which may contain a halogen atom or a hydrogen atom, and $R^{30}$ and $R^{31}$ each represents a monovalent hydrocarbon group which may contain a halogen atom or a hydrogen atom, or represents a divalent hydrocarbon group formed by the combination of both, which may have a halogen atom.

The monovalent hydrocarbon groups which may have a alogen atom, which are represented by each of the above-mentioned $R^7$, $R^8$, $R^9$, $R^{10}$, $R^{11}$, $R^{12}$, $R^{13}$, $R^{14}$, $R^{15}$, $R^{16}$, $R^{18}$, $R^{20}$, $R^{21}$, $R^{22}$, $R^{23}$, $R^{25}$, $R^{26}$, $R^{28}$, $R^{30}$, and $R^{31}$, are preferably a halogenoalkyl, halogenoaryl, halogenoaralkyl, alkyl, aryl, or aralkyl group having from 1 to 20 carbon atoms, exemplified above regarding $R^1$ and $R^2$. Divalent hydrocarbon groups which may have a halogen atom, which is formed by the combination of the above-mentioned $R^8$ and $R^9$, $R^{10}$ and $R^{11}$, $R^{13}$ and $R^{41}$, $R^{15}$ and $R^{16}$, $R^{20}$ and $R^{21}$, $R^{25}$ and $R^{26}$, and $R^{30}$ and $R^{31}$ are preferably those groups exemplified above regarding $R^1$ and $R^2$. Divalent hydrocarbon groups which may have a halogen atom, which are represented by each of $R^{17}$, $R^{19}$, $R^{27}$, and $R^{29}$ are preferably divalent saturated aliphatic hydrocarbon groups having from 1 to 20 carbon atoms such as methylene, ethylidene, isopropylidene, etc.; divalent aromatic hydrocarbon group having from 6 to 20 carbon atoms such as phenylene, methylphenylene, etc.; divalent saturated aliphatic hydrocarbon groups containing a halogen atom having from 2 to 20 carbon atoms; divalent aromatic hydrocarbon groups containing a halogen atom having from 6 to 20 carbon atoms; etc. Furthermore, x-valent hydrocarbon groups which may have a halogen atom, which is represented by the above-mentioned $R^{24}$ are preferably divalent saturated aliphatic hydrocarbon groups which may have a halogen atom such as ethylene, trimethylene, 2,2-dimethyltriethylene, 2,2-bis(chloromethyl)trimethylene, 2,2-bis(bromomethyl) trimethylene, etc.; trivalent saturated aliphatic hydrocarbon groups having from 3 to 20 carbon atoms which may have a halogen atom such as groups represented by $CH_3—C(—CH_2—)_3$, $CH_3CH_2—C(—CH_2—)_3$; etc.

Specific examples of these compounds are described below.

P-1

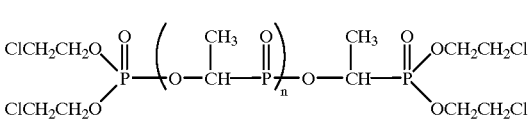

P-2

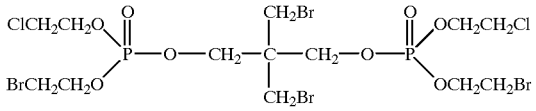

P-3

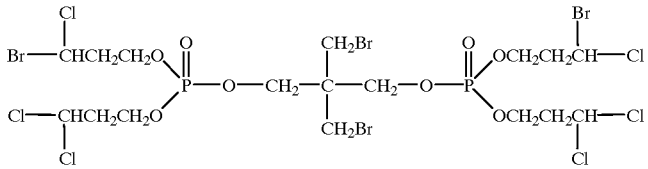

P-4

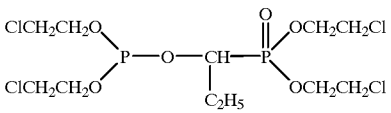

-continued

P-5

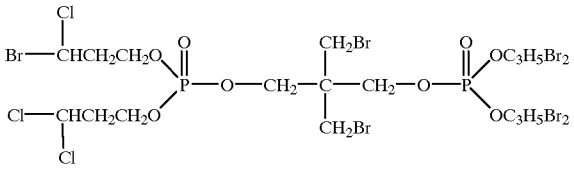

P-6

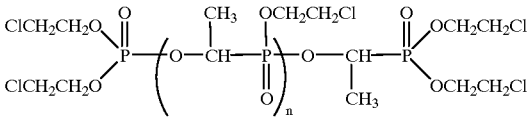

P-7

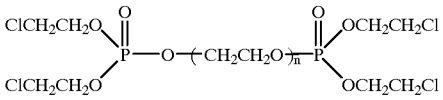

P-8

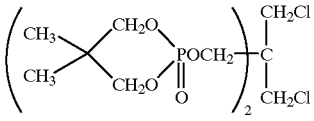

P-9

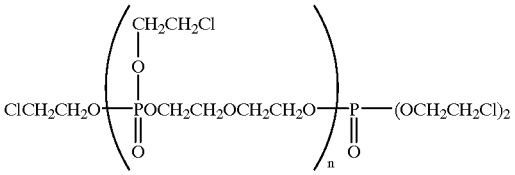

P-10

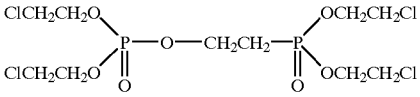

P-11

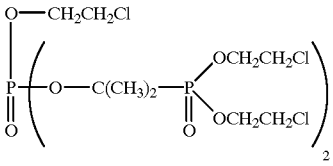

The employed amount of these fire-retardants is between 1 and 50 parts by weight to 100 parts by weight entire resins; is more preferably between 3 and 45 parts by weight, and more preferably between 7 and 40 parts by weight. When the amount exceeds 50 parts by weight, the strength, heat-resistant temperature, keeping quality, repeated use stability, and mechanical physical properties may occasionally be deteriorated. When the amount is not more than one part by weight, the incombustible effect may occasionally be lowered.

The practical added amount is appropriately determined in accordance with the desired level regarding incombustibility, mechanical and heat resistance physical properties, and transparency. For example, it is preferred to select them so as to be in V-0 Class of UL-94 Standard.

The fire-retardant-containing photoreceptor substrate of the present invention is naturally provided with incombustibility. In addition, there is an advantage in which when the substrate can be taken out from the mold without causing scar after completion of the production, likely due to the fact that the fire-retardant exhibits a plastic effect.

Next, explained is a member in which the transparent substrate of the present invention is employed for an electrophotographic photoreceptor. The surface of the cylindrical substrate of the present invention is smooth. Particularly, when methacrylic acid methyl ester polymer is employed, the transparency is markedly excellent and the strength is high. Accordingly, the resulting substrate is suitable for the image forming apparatus employing a mechanism in which exposure is carried out from the inside.

The representative photoreceptor is one in which an electrically conductive layer and a photoconductive photosensitive layer are provided onto the surface of a cylindrical substrate, and conventional methods can widely be employed to provide the electrically conductive layer and the photoconductive photosensitive layer.

Namely, as the electrically conductive transparent layer forming method, vacuum evaporation or spattering of metal or metallic oxides such as aluminum, ITO (indium tin oxide), etc. and coating layer formation of electrically conductive resin obtained by mixing fine ITO or fine electrically conductive alumina particles with a resin are representative.

In order to improve the adhesion and coating properties of a photosensitive layer, to cover the defect on a substrate, and to improve charge injection to a charge generating layer, an interlayer (a subbing layer) may be provided under a charge generating layer. Employed as subbing layer materials are alcohol-soluble polyamides, copolymerized nylon, alkoxymethylated nylon, vinyl chloride-vinyl acetate copolymers, casein, polyvinyl alcohol, cellulose, gelatin, or as described in Japanese Patent Publication Open to Public Inspection No. 9-68870, a hardening type subbing layer employing metal alkoxides, organic metal chelates, silane coupling agents is used. These are coated so that the layer thickness becomes between about 0.01 and about 5 $\mu$m.

Furthermore, with the formation of a photosensitive layer, an inorganic photoconductive material layer may be formed employing vacuum evaporation, etc. However, it is preferred that an organic photoconductive material layer is formed by coating an organic photosensitive material which is of a function separation type comprising an organic photoconductive material layer, particularly, comprising a charge transfer material and a charge generating material, particularly, of a type in which each is independently multicoated.

The charge generating layer (CGL) is formed by dispersing a charge generating material (CGM) into a binder resin as desired. Listed as CGM are metal or metal-free phthalocyanine compounds, azo compounds such as bisazo compounds, trisazo compounds, etc., squarium compounds, azulenium compounds, perylene series compounds, indigo compounds, quinacridone compounds, polycyclic quinone series compounds, cyanine dyes, xanthene dyes, charge transfer complexes consisting of poly-N-vinylcarbazole and trinitrofluorenone. However, the present invention is not limited to these. Furthermore, these may be employed in combinations of two or more, if desired. Imidazolperylene compounds and titanyl phthalocyanine (TiOPc), a type of metal phthalocyanine, are preferred.

Furthermore, listed as binders which may be employed for the charge generating layer are, for example, polystyrene resins, polyethylene resins, polypropylene resins, polyacrylic resins, polymethacrylic resins, polyvinyl chloride resins, polyvinyl acetate resins, polyvinyl butyral resins, polyepoxy resins, polyurethane resins, polyphenol resins, polyester resins, polyalkyd resins, polycarbonate resins, polysilicone resins, polymelamine resins, and copolymers containing at least two of the repeating unit of these resins, for example, vinyl chloride-vinyl acetate copolymer resins, vinyl chloride-vinyl acetate-maleic acid anhydride copolymer resins, or polymer organic semiconductors, for example, poly-N-vinylcarbazole, etc. However, the present invention is not limited to these compounds. Of those described above, when as CGM, an imidazoleperylene compound is used, as preferred binders, polysilicone resins and polyvinyl butyral resins or mixture thereof, etc. are listed.

The charge transport layer (CTL) is composed of a charge transport material (CTM) alone or CTM together with a binder resin. Listed as CTM are, for example, carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline derivatives, oxazolone derivatives, benzimidazole derivatives, quinazoline derivatives, benzofuran derivatives, acridine derivatives, phenazine derivatives, aminostilbene derivatives, triarylamine derivatives, phenylenediamine derivatives, stilbene derivatives, benzidine derivatives, poly-N-vinylcarbazole, poly-1-vinylpyrene, poly-9-vinylanthracene, etc. However, the present invention is not limited to these. These may be employed individually or in combination.

Furthermore, listed as binder resins employable for the charge transport layer are, for example, polycarbonate resins, polyacrylic resins, polyester resins, polystyrene resins, styrene-acrylonitrile copolymer resins, polymethacrylic acid ester resins, styrene-methacrylic acid ester copolymer resins, etc. However, the present invention is not limited to these.

In addition, in order to minimize the degradation due to fatigue during repeated use, or to improve durability, into any layer of a photoreceptor, added can be conventionally known antioxidants, UV absorbers, electron acceptable materials, surface improving agents, plasticizers, etc. if desired.

Furthermore, for the improvement of durability, a non-light sensitive layer such as a protective layer, etc. may be provided, in addition to the sensitive layer.

Figure 4:
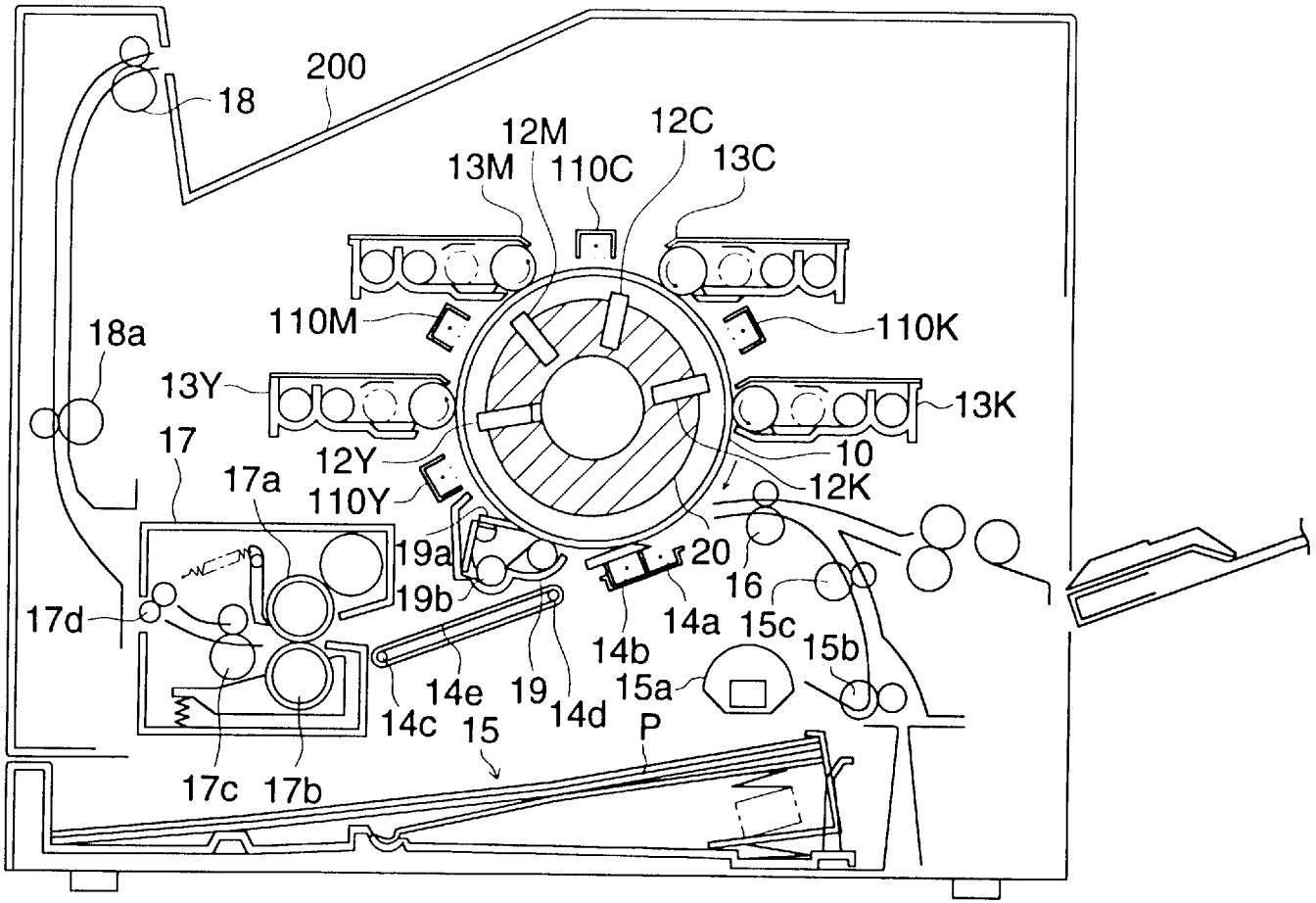
FIG. 4 is a sectional view of the image forming apparatus of the present invention.

Next, the embodiment of a color image forming apparatus mounted with the photoreceptor employing the cylindrical substrate of the present invention is described with reference to FIG. 4, showing a sectional view of an image forming apparatus.

References 110Y, 110M, 110C, and 110K are corona charging devices which are employed in the image forming process of each of yellow (Y), magenta (M), cyan (C), and black (K), respectively which carry out charging through corona discharging so as to maintain predetermined electrical potential of charge to the above-mentioned photosensitive layer of a photoreceptor 10, and render uniform electrical potential onto the photoreceptor 10.

References 12Y, 12M, 12C, and 12K are optical exposure systems which are exposure devices composed as a unit consisting of a selfoc lens as a size-for-size image focusing element and an exposure element such as FL (fluorescent light emission) in which emission elements arranged in the axial direction of the photoreceptor 10 are linearly arranged in an array, EL (electroluminecsence), PL (plasma discharge), LED (light-emitting diode), and LISA (light switching array) in which elements having an optical shutter function are linearly arranged, PLZT (transmission type piezoelectric element shutter array), LCS (liquid crystal shutter), etc., and image signals of each color read employing a separated image reading device is successively retrieved from the memory and is inputted to the above-mentioned exposure optical systems 12Y, 12M, 12C, and 12K as electrical signals, respectively. Each of the above-mentioned exposure optical systems 12Y, 12M, 12C, 12K is mounted to a cylindrical maintaining member 20, and is placed in the inside of the substrate of the above-mentioned photoreceptor 10.

References 13Y, 13M, 13C, and 13K are non-contact development method employing development devices which store yellow (Y), magenta (M), cyan (C), and black (K) developer materials, respectively, and each of them is provided with a development sleeve which maintains a specified gap from the circumferential surface of the photoreceptor 10 and rotates in the same direction.

The above-mentioned development devices 13Y, 13M, 13C, and 13K reverse-develop, under a non-contact state with the application of development bias voltage, an electrostatic latent image which is formed on the photoreceptor 10 by charging employing the above-mentioned corona charging devices 110Y, 110M, 110C and 110K, and image exposure employing the exposure optical systems 12Y, 12M, 12C, and 12K.

In a separate image reading device, the image of an original document read by an imaging device or the image edited by a computer is temporarily stored in a memory as Y, M, C, and K color image signals.

When image recording starts, a photoreceptor driving motor rotates the photoreceptor 10 clockwise and at the same time, the corona charging device 110Y charges the photoreceptor 10 through the charging action.

After the photoreceptor is charged, in the above-mentioned exposure optical system 12Y, exposure starts in accordance with electrical signals corresponding to first color signals, e.g. yellow (Y) image signals, and an electrostatic latent image corresponding to the yellow image portions of the original document image is formed on the surface of the photosensitive layer through scanning along with the drum rotation.

The above-mentioned latent image is reverse-developed under a non-contact state of the developer material on the development sleeve employing the development device 13Y, and a yellow (Y) toner image is formed along with the rotation of the photoreceptor 10.

Next, the photoreceptor is recharged further on the above-mentioned yellow (Y) toner image through a charging action employing the corona charging device 110M; exposure is carried out in accordance with electrical signals corresponding to second color signals of the exposure optical system 12M, e.g. the magenta (M) image signals, and a magenta image is successively superimposed and formed through the non-contact reversal development employing the development device 13M.

In the same process, employing the corona charging device 110C, exposure optical system 12C, and development device 13C, a cyan (C) toner image corresponding to third color signals is further formed; furthermore, employing the corona charging device 110K, exposure optical system 12K and development device 14K, a black (K) toner image corresponding to fourth color signals is successively superimpose-formed, and within one rotation of the photoreceptor 10, superimposed toner images are formed on the circumferential surface.

Exposure to the photosensitive layer of the photoreceptor 10 employing these exposure optical systems 12Y, 12M, 12C, and 12K is carried out through the above-mentioned transparent substrate from the inside of the substrate. Accordingly, any image exposure corresponding to the second, third, and fourth color signals is carried out perfectly free from the influence due to the previously formed toner image and it becomes possible to form an electrostatic latent image equivalent to that corresponding to the first color signals. Further, temperature stabilization and minimization of temperature rise in the photoreceptor drum due to heat emission from the exposure optical systems 12Y, 12M, 12C, and 12K is carried out employing an excellent heat conductive material; when the temperature is low, a heater is employed; when the temperature is high, heat is dissipated to the outside via a heat pipe, and employing such means, temperature is controlled to a level so as to cause no practical problem.

Subsequently, the superimposed toner color images formed on the circumferential surface of the photoreceptor drum are ejected employing an ejecting roller 15*a* from a paper feeding cassette 15 in a transfer device 14*a*; are then conveyed to a timing roller 16 employing paired conveyance rollers 15*b* and 15*c*; and are transferred to a transfer sheet P used as a transfer material in synchronization with the superimposed toner images on the photoreceptor 10 employing with driving the timing roller 16.

The transfer sheet P, to which the toner images have been transferred, is subjected to charge elimination at a charge eliminating device 14*b* and is separated from the circumferential surface of the drum; is then conveyed to a fixing device 17 employing a conveyance belt 14*e* entrained about a conveyance driving roller 14*c* and a driven roller 14*d*. In the fixing device 17, being heated and brought into pressure-contact between a fixing roller 17*a* and a pressure-contact roller 17*b*, toners are melt-fixed onto the transfer sheet P and the resulting transfer sheet is then ejected from the fixing device 17 employing paired fixing outlet rollers 17*d*; is ejected onto an ejected sheet tray 200 in the upper part of the apparatus while being conveyed employing paired ejected sheet conveyance rollers 18*a* via a sheet ejection roller 18. The apparatus employing the above-mentioned photoreceptor substrate of the present invention produced excellent clear and sharp images.

On the other hand, the surface of a photoreceptor 10, from which a transfer sheet has been separated, is scraped by a cleaning blade 19*a* in a cleaning device 19 and residual toner is remove-cleaned and the formation of the toner image of an original document image is continued or upon terminating operation once, the formation of the toner image of a new original image is commenced. The waste toners scraped by the cleaning blade 19*a* are ejected to a waste toner vessel (not shown) employing a toner conveyance screw 19*b*.

Because in the above-mentioned image forming process, an image was obtained employing the superposition of images during a single rotation of a photoreceptor drum, the image was prepared in a high speed and furthermore, was excellent in resolving power as well as sharpness.

In the above-mentioned photoreceptor 10, the exposure optical systems are provided in the inside. Accordingly, though the diameter of the drum is relatively small, it is possible to arrange a plurality of the above-mentioned corona charging devices 110Y, 110M, 110C, and 110K, development devices 13Y, 13M, 13C, and 13K, etc. on the outer circumferential surface and thus to decrease the volume of an apparatus employing a drum with a short diameter of 30 to 150

An example employing color toners is described above. In the case of monochromatic images, contact development is preferred.

The substrate of the present invention may also be applied to an apparatus which employs no corona charging device, as described in Japanese Patent Publication Open to Public Inspection No. 6-230634.

EXAMPLES

The present invention will be detailed below with reference to examples.

Example 1-1

Example and a Comparative Example

1. Production of a Cylindrical Substrate

To a methyl acrylate monomer, azobisisobutylonitrile (AIBN), a polymerization initiator, was added and preliminary polymerization was carried out at 40° C. for one hour to obtain a polymerizable liquid material with a viscosity of approximately 100 cp, simulating syrup. The resulting polymerizable liquid material was poured into a cylindrical mold having an inner diameter of 100 mm and a length of 800 mm. While the material was brought into close contact along the inner wall employing a centrifugal force generated by rotating the mold, polymerization was carried out by heating the entire mold according to the temperature and time schedule of 70° C. and 8 hours, 80° C. and 8 hours, and 100° C. and 20 hours. The resulting substrate was subjected to an annealing treatment to room temperature at a rate of 0.2° C./minute, and then was taken out from the mold. The outer surface and inner surfaces of obtained substrate were polished so as to result in a roughness as shown in Table 1-1 and the ends were cut and machined to obtain a cylindrical substrate having an outer diameter of 100 mm and a length of 360 mm as shown in Table 1-1. The thus obtained substrate was denoted No. 1.

Onto the above-mentioned cylindrical substrate an electrically conductive layer coating composition described below was coated so as to obtain a dry thickness of 0.5 μm, and the resulting coating was subjected to thermal treatment at 80° C. for 30 minutes.

2. Electrically Conductive Layer Coating Composition

| | |
|---|---|
| Electrically conductive coating material X-101H (manufactured by Sumitomo Kinzoku Kozan, Ltd.) | 1,000 g |
| Toluene | 1,000 g |

Onto the above-mentioned substrate, an interlayer (UCL) coating composition UCL-1 described below was coated so as to obtain a dry thickness of 0.5 μm.

3. UCL-1 Coating composition

| | |
|---|---|
| Copolymer Nylon Resin (CM-8000 manufactured by Toray Industries Inc.) | 3 g |
| Methanol/n-butanol = 10/1 (volume ratio) | 1,000 ml |

Onto the above-mentioned coated UCL, a CGL layer coating composition CGL-1 described below was coated so as to obtain a dry thickness of 0.25 μm.

4. CGL-1 Coating Composition

| | |
|---|---|
| Y-type titanyl phthalocyanine (CGM-1) | 20 g |
| Silicone resin (KR-5240, manufactured by Shin-Etsu Kagaku Co.) | 40 g |
| 2-Butanone | 1,000 g |

(Composition which was obtained by dispersing the above-mentioned composition for 10 hours employing a sand mill)

Onto the above-mentioned coated CGL, a CTL layer coating composition CTL-1 described below was coated so as to obtain a dry thickness of 25 μm and was subsequently subjected to thermal treatment at 90° C. for one hour to obtain Photoreceptor Drum No. A.

5. CTL-1 Coating Composition

| | |
|---|---|
| CTM-1 | 80 g |
| Polycarbonate (Z-22, manufactured by Mitsubishi Gas Kagaku Co.) | 120 g |
| 1,2-Dichloroethane | 1,000 g |

CTM-1

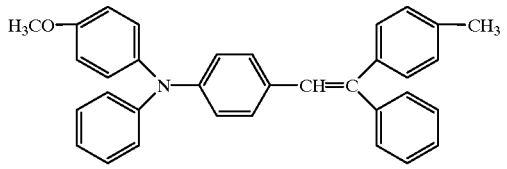

Comparative Example

A comparative photoreceptor substrate was prepared in the same manner as Example 1, except that the surface roughness was altered as shown in Table 1-1. This Comparative Substrate was denoted No. 1S and Photoreceptor Drum was denoted No. 1S.

Example 1-2

Example and Comparative Example

1. Production of Cylindrical Substrate

To mixed monomer of α-methylstyrene/methyl methacrylate/ethylene glycol dimethacrylate (at a 2/8/2 weight ratio) azobisisobutylonitrile (AIBN), a polymerization initiator was added, and preliminary polymerization was carried out at 50° C. for 3 hours to obtain a polymerizable liquid material with a viscosity of approximately 100 cp, simulating syrup. The resulting polymerizable liquid material was poured into a cylindrical mold having an inner diameter of 100 mm and a length of 800 mm. While the material was brought into close contact along the inner wall employing a centrifugal force generated by rotating the mold, polymerization was carried out by heating the entire mold to 100° C. at a heating rate of 0.5° C./minute. The resulting substrate was subjected to an annealing treatment to room temperature at a rate of 0.2° C./minute, and then was taken out from the mold. The outer and inner surfaces the obtained substrate were polished so as to result in roughness as shown in Table 1-1 and the ends were cut and machined to obtain a cylindrical substrate having an outer diameter of 100 mm and a length of 360 mm as shown in Table 1-1. The thus obtained substrate was denoted No. 2.

Onto the above-mentioned cylindrical substrate, an electrically conductive layer coating composition described below was coated so as to obtain a dry thickness of 0.5 μm, and the resulting coating was subjected to thermal treatment at 80° C. for 30 minutes.

2. Electrically Conductive Layer Coating Composition

| | |
|---|---|
| Electrically conductive coating material X-101H manufactured by Sumitomo Kinzoku Kozan, Ltd. | 1,000 g |
| Toluene | 1,000 g |

Onto the above-mentioned substrate, an interlayer (UCL) coating composition UCL-2 described below was coated so as to obtain a dry thickness of 1.0 μm.

3. UCL-2 Coating Composition

| | |
|---|---|
| Titanium chelate compound TC-750 (manufactured by Matsumoto Seiyaku Co.) | 200 g |
| Silane coupling agent KBM-503 (manufactured by Shin-Etsu Kagaku Co.) | 130 g |
| 2-Propanol | 1,000 g |

Onto the above-mentioned coated UCL, a CGL layer coating composition CGL-1 described below was coated so as to obtain a dry thickness of 0.25 μm.

4. CGL-1 Coating Composition

| | |
|---|---|
| Y-type titanyl phthalocyanine (CGM-1) | 20 g |
| Silicone resin (KR-5240, manufactured by Shin-Etsu Kagaku Co.) | 40 g |
| 2-Butanone | 1,000 g |

(Composition which was obtained by dispersing the above-mentioned composition for 10 hours employing a sand mill)

Onto the above-mentioned coated CGL, a CTL layer coating composition CTL-1 described below was coated so as to obtain a dry thickness of 25 μm and was subjected to thermal treatment at 90° C. for one hour to obtain Photoreceptor Drum No. A.

5. CTL-1 Coating Composition

| | |
|---|---|
| CTM-1 | 80 g |
| Polycarbonate (Z-200, manufactured by Mitsubishi Gas Kagaku Co.) | 120 g |
| 1,2-Dichloroethane | 1,000 g |

Comparative Example

Comparative photoreceptor substrate was prepared in the same manner as Example 2, except that the surface roughness was altered as shown in Table 1-1. This Comparative Substrate was denoted No. 2S and Photoreceptor Drum was denoted No. 2S.

1. Practical Image Forming Test

Each of Photoreceptor Drums No. 1, No. 1S, No. 2, and No. 2S were mounted to an inner exposure system image forming apparatus employing an electrophotographic system having a structure shown in FIG. 4; images were formed on 10,000 sheets, and resulting images were evaluated.

(1) Image Evaluation

Image evaluation was performed in terms of character printing properties. Character image information was inputted to a photoreceptor employing LED light and the character image was evaluated for quality, which was formed on a plain paper employing the above-mentioned image forming processes.

(2) Sharpness

An image having varied numbers of fine lines per mm width was formed in the same manner as described above and the number of lines/mm which were discernible was evaluated for sharpness.

(3) Cellophane Adhesive Tape Test

The surface of the transparent substrate (coated with an electrically conductive layer) which had not been coated with a photosensitive layer was scarred to a width of 1 mm employing a razor and cellophane adhesive tape (at a width of 1.5) was adhered at a right angle to the scars. Then, the cellophane adhesive tape was pulled with enough force to peel it off. After that, the photosensitive layer was coated and the effect to a subsequently formed image was inspected.

Table 1-1 shows the results thereof.

TABLE 1-1

| Substrate | Substrate Roughness (Surface) μm | Substrate Roughness (Interior Surface) μm | Undulation (Interior Surface Side) μm | Cellophane Adhesive Tape Test | Image Evaluation | Sharpness lines/mm |
|---|---|---|---|---|---|---|
| No. 1 | 0.23 | 0.02 | 1.0 | Good | good from the start | 6 to 7 good |
| No. 2 | 1.8 | 0.4 | 1.2 | Good | good from the start | 8 good |
| No. 1S | 0.1 | 0.005 | 0.05 | formation of partly image defects due to insufficient adhesion | formation of image defects due to layer peeling from about 2,000 sheets bad | partly 4 lines (partly good, partly bad) |
| No. 2S | 2.3 | 0.6 | 5.5 | Good | formation of partly, background staining, blur, partly background staining due to internal reflection and stray light | partly 3 lines |

*The undulation of interior surface implies $W_{CM}$ of standard length of 0.25 mm in JIS B0610

As shown in Table 1-1, by making the Rz of the outer surface of the substrate of the present invention between 0.2 and 2.0 μm, and the Rz of the inner surface thereof not more than 0.5 μm, a photoreceptor was obtained which exhibited excellent adhesion to the coating layer, causes neither blurring nor background staining, exhibited excellent sharpness and further, excellent stability in image characteristics.

Example 2-1

1. Production of the Cylindrical Substrate

A polymerizable liquid substance prepared by employing materials and mixing at the ratio described in Table 2-1 was heated and was subjected to preliminary polymerization at 40° C. for one hour to obtain an oligomer polymerizable liquid material, simulating syrup.

The resulting polymerizable liquid material was poured into a cylindrical mold having an inner diameter of 100 mm and a length of 800 mm. While the material was brought into close contact along the inner wall employing a centrifugal force generated by rotating the mold, polymerization was carried out by heating the entire mold according to the temperature and time schedule of 70° C. and 8 hours, 80° C. and 8 hours, and 100° C. and 20 hours. The resulting substrate was subjected to an annealing treatment to room temperature at a rate of 0.2° C./minute, and was then taken out from the mold. The ends of the obtained substrate were cut and machined to obtain a cylindrical substrate having an outer diameter of 100 mm and a length of 360 mm. When taken out from the metal mold, contusion resulted in the center part. The resulting substrate was cut under conditions of a cutting speed of 645 m/minute, carving of 50 μm, and a feed of 23 μm/rev employing a diamond single crystal bite (R(nose R20 mm)), and was then subjected to buffing. The obtained substrate was washed and dried, and polymer Base Bodies No. 2-1, 2-2, and 2-3 were obtained. The Rz of these base bodies was in the range of 0.1 to 1.2 μm.

Onto the above-mentioned cylindrical substrate, an electrical conductive layer coating composition described below was coated so as to obtain a dry thickness of 0.5 μm and the resulting coating was subjected to a thermal treatment at 80° C. for 30 minutes.

2. Electrically Conductive Layer Coating Composition

| | |
|---|---|
| Electrically conductive coating material X-101H manufactured by Sumitomo Kinzoku Kozan, Ltd. | 1,000 g |
| Toluene | 1,000 g |

Onto the above-mentioned substrate, an interlayer (UCL) coating composition UCL-2 described below was coated so as to obtain a dry thickness of 0.5 μm.

3. UCL-1 Coating Composition

| | |
|---|---|
| Copolymer nylon resin (CM-8000, manufactured by Toray Industries Inc.) | 3 g |
| Methanol/n-butanol = 10/1 (volume ratio) | 1,000 ml |

Onto the above-mentioned coated UCL, a CGL layer coating composition CGL-1 described below was coated so as to obtain a dry thickness of 0.25 μm.

4. CGL-1 Coating Composition

| | |
|---|---|
| Y-type titanyl phthalocyanine (CGM-1) | 20 g |
| Silicone resin (KR-5240, manufactured by Shin-Etsu Kagaku Co.) | 40 g |
| 2-Butanone | 1,000 g |

(Composition which was obtained by dispersing the above-mentioned composition for 10 hours employing a sand mill)

Onto the above-mentioned coated CGL, a CTL layer coating composition CTL-1 described below was coated so as to obtain a dry thickness of 25 μm and the resulting coating was subjected to thermal treatment at 100° C. for one hour and Photoreceptor Drums 2-1, 2-2, and 2-3 were obtained.

5. CTL-1 Coating Composition

| | |
|---|---|
| CTM-1 | 80 g |
| Polycarbonate (Z-200, manufactured by Mitsubishi Gas Kagaku Co.) | 120 g |
| 1,2-Dichloroethane | 1,000 g |

TABLE 2-1

| Substrate | Monomer: Radical Polymerizable Monomer (weight % of entire monomers) | | | | Cross-linking Agent (weight % of entire monomers) | | Initiator (weight % of entire monomers) |
|---|---|---|---|---|---|---|---|
| No. | Monomer A | Ratio | Monomer B | Ratio | Cross-linking Monomer | Ratio | |
| 2-1 | methyl methacrylate | 100 | — | — | — | | azoiso-butylonitrile 1.0% |
| 2-2 | methyl methacrylate | 80 | α-methylstyrene | 15 | diethylene glycol dimethacrylate | 5 | azoiso-butylonitrile 1.0% |
| 2-3 | methyl methacrylate | 70 | — | — | trimethanol propane trimethacrylate | 30 | azoiso-butylonitrile 1.0% |

Example 2-2

1. Production of the Cylindrical Substrate

A polymerizable liquid substance prepared by employing materials and mixing ratio as described in Table 2-2 was heated and was subjected to preliminary polymerization at 40° C. for one hour to obtain an oligomer polymerizable liquid material, simulating syrup. The resulting polymerizable liquid material was poured into a cylindrical mold having an inner diameter of 100 mm and a length of 800 mm. While the material was brought into close contact along the inner wall employing a centrifugal force upon rotating the mold, polymerization was carried out by heating the entire mold to 100° C. at a heating rate of 0.5° C./minute for 10 hours. The resulting substrate was subjected to an annealing treatment to room temperature at a rate of 0.2° C./minute, and was then taken out from the mold. The ends of the obtained substrate were cut and machined to obtain a cylindrical substrate having an outer diameter of 100 mm and a length of 360 mm. Because the surface of the substrate taken out from the metal mold suffered slight abrasion, it was subjected to buffing, and was washed and dried, and transparent Base Bodies No. 2-4, 2-5, and 2-6 were obtained. The Rz of these base bodies was in the range of 0.5 to 2.0 μm.

Onto the above-mentioned cylindrical substrate, an electrical conductive layer coating composition described below was coated so as to obtain a dry thickness of 0.5 μm and the resulting coating was subjected to a thermal treatment at 80° C. for 30 minutes.

2. Electrically Conductive Layer Coating Composition

| | |
|---|---|
| Electrically conductive coating material X-101H manufactured by Sumitomo Kinzoku Kozan, Ltd. | 1,000 g |
| Toluene | 1,000 g |

Onto the above-mentioned substrate, an interlayer (UCL) coating composition UCL-2 described below was coated so as to obtain a dry thickness of 1.0 μm.

3. UCL-2 Coating Composition

| | |
|---|---|
| Titanium chelate compound TC-750 (manufactured by Matsumoto Seiyaku Co.) | 200 g |
| Silane coupling agent KBM-503 (manufactured by Shin-Etsu Kagaku Co.) | 130 g |
| 2-Propanol | 1,000 g |

-continued

Onto the above-mentioned coated UCL, CGL layer coating composition CGL-1 described below was coated so as to obtain a dry thickness of 0.25 μm.

4. CGL-1 Coating Composition

| | |
|---|---|
| Y-type titanyl phthalocyanine (CGM-1) | 20 g |
| Silicone resin (KR-5240, manufactured by Shin-Etsu Kagaku Co.) | 40 g |
| 2-Butanone | 1,000 g |

(Composition which was obtained by dispersing the above-mentioned composition for 10 hours employing a sand mill)

Onto the above-mentioned coated CGL, a CTL layer coating composition CTL-1 described below was coated so as to obtain 25 μm and the resulting coating was subjected to thermal treatment at 100° C. for one hour and Photoreceptor Drums No. 4, 5, and 6 were obtained.

5. CTL-1 Coating Composition

| | |
|---|---|
| CTM-1 | 80 g |
| polycarbonate (Z-200, manufactured by Mitsubishi Gas Kagaku Co.) | 120 g |
| 1,2-Dichloroethane | 1,000 g |

TABLE 2-2

| Substrate No. | Monomer: Radical Polymerizable Monomer (weight % of entire monomers) Monomer A | Ratio | Monomer B | Ratio | Cross-linking Agent (weight % of entire monomers) Cross-linking Monomer | Ratio | Initiator (weight % of entire monomers) |
|---|---|---|---|---|---|---|---|
| 2-4 | methyl metha-crylate | 80 | α-methylstyrene | 20 | — | | benzoyl peroxide 0.5% |
| | | | — | — | | | |
| 2-5 | methyl metha-crylate | 75 | α-styrene | 15 | diethylene glycol bisallyl-carbonate | 10 | benzoyl peroxide 0.5% |
| 2-6 | methyl metha-crylate | 70 | benzyl methacrylate | — | trimethanol propane trimethacryl | 13 | benzoyl peroxide 0.5% |

6. Practical Image Forming Test

Each of Photoreceptor Drums No. 2-1 through 2-6 of the present invention was mounted to an inner exposure system image forming apparatus employing an electrophotographic system having a structure shown in FIG. 4; images are formed on 50,000 sheets. Table 2-3 shows the results.

TABLE 2-3

| Photoreceptor Drum No. | Circularity/ Cylindricality after Copying 50,000 Sheets (μm) | Image Quality (A4 Copy Paper) | Resolution (lines/mm) | Light Transmittance |
|---|---|---|---|---|
| No. 2-1 | 52/55 | formation of image unevenness and blurring | 3 in degraded area | not less than 90% |
| No. 2-2 | 31/31 | good from start to completion of copying 50,000 sheets | 8 | not less than 90% |
| No. 2-3 | 28/30 | good from start to completion of copying 50,000 sheets | 8 | not less than 90% |
| No. 2-4 | 55/57 | formation of image unevenness and blurring | 4 in degraded area | not less than 90% |
| No. 2-5 | 28/31 | good from start to completion of copying 50,000 sheets | 8 | not less than 90% |
| No. 2-6 | 27/27 | good from start to completion of copying 50,000 sheets | 8 | not less than 90% |

Because Samples No. 2-2, 2-3, 2-5, and 2-6 resulted in neither contusion nor abrasion due to high heat resistance and high cylindricality and circularity, and no image defect. Thus photoreceptors were obtained, which exhibited high heat resistance and mechanical pushed pressure resistance during repeated use and high stability during repetition.

Example 3-1

1. Production of the Cylindrical Substrate

A polymerizable liquid substance prepared by employing formulas as described in Table 3-1 was heated and was subjected to preliminary polymerization at 40° C. for one hour to obtain an oligomer polymerizable liquid material, simulating syrup. The resulting polymerizable liquid material was well stirred and was poured into a cylindrical mold having an inner diameter of 100 mm and a length of 800 mm. While the material was brought into close contact along the inner wall employing a centrifugal force generated by rotating the mold, polymerization was carried out by heating the entire mold according to the temperature and time schedule of 70° C. and 8 hours, 80° C. and 8 hours, and 100° C. and 20 hours. The resulting substrate was subjected to an annealing treatment to room temperature at a slow rate of 0.05° C./minute, and was then taken out from the mold. The ends of the obtained substrate were cut and machined to obtain three cylindrical base bodies with an outer diameter of 100 mm and a length of 360 mm. After each was subjected to buffing, it was washed and dried, and transparent Base Bodies No. 3-2, 3-3, and 3-4 were obtained.

Onto the above-mentioned cylindrical substrate, an electrical conductive layer coating composition described below was coated so as to obtain a dry thickness of 0.5 μm and the resulting coating was subjected to thermal treatment at 80° C. for 30 minutes.

Further, as a comparative example, a substrate was produced in the same manner as above, except that formula No. A was employed and the above-mentioned polymerizable liquid substance was poured to a mold without paying special attention and the annealing treatment rate was 0.2° C./minute, and a produced substrate was denoted No. 3-1.

2. Electrically Conductive Layer Coating Composition Electrically conductive coating

| | |
|---|---|
| Electrically conductive coating material X-101H manufactured by Sumitomo Kinzoku Kozan, Ltd. | 1,000 g |
| Toluene | 1,000 g |

Onto the above-mentioned substrate, an interlayer (UCL) coating composition UCL-1 described below was coated so as to obtain a dry thickness of 0.5 μm.

3. UCL-1 Coating Composition

| | |
|---|---|
| Copolymer nylon resin (CM-8000, Titanium manufactured by Toray Industries Inc.) | 3 g |
| Methanol/n-butanol = 10/1 (volume ratio) | 1,000 ml |

Onto the above-mentioned coated UCL, a CGL layer coating composition CGL-1 described below was coated so as to obtain a dry thickness of 0.25 μm.

4. CGL-1 Coating Composition

| | |
|---|---|
| Y-type titanyl phthalocyanine (CGM-1) | 20 g |
| Silicone resin (KR-5240, manufactured by Shin-Etsu Kagaku Co.) | 40 g |
| 2-Butanone | 1,000 g |

(Composition which was obtained by dispersing the above-mentioned composition for 10 hours employing a sand mill)

Onto the above-mentioned coated CGL, a CTL layer coating composition CTL-1 described below was coated so as to obtain 25 μm and the resulting coating was subjected to a thermal treatment at 100° C. for one hour and Photoreceptor Drums No. 1 through 4 were obtained.

5. CTL-1 Coating Composition

| | |
|---|---|
| CTM-1 | 80 g |
| Polycarbonate (Z-200, manufactured by Mitsubishi Gas Kagaku Co.) | 120 g |
| 1,2-Dichloroethane | 1,000 g |

2. Electrically Conductive Layer Coating Composition

| | |
|---|---|
| Electrically conductive coating material X-101H manufactured by Sumitomo Kinzoku Kozan, Ltd. | 1,000 g |
| Toluene | 1,000 g |

TABLE 3-1

| Substrate No. | Formula No. | Monomer: Radical Polymerizable Monomer (weight % of entire monomers) Monomer A | Ratio | Monomer B | Ratio | Cross-linking Agent (weight % of entire monomers) Cross-linking Monomer | Ratio | Initiator (weight % of entire monomers) |
|---|---|---|---|---|---|---|---|---|
| 3-1 | A | acrylonitrile | 25 | styrene | 75 | — | — | benzoyl peroxide 1.0 |
| 3-2 | A | methyl methacrylate | 55 | styrene | 35 | trimethylolpropane trimethacrylate | 10 | benzoyl peroxide 1.0 |
| 3-3 | B | methyl methacrylate | 75 | cyclohexyl methacrylate | 20 | diethylene glycol dimethacrylate | 5 | benzoyl peroxide 1.0 |
| 3-4 | C | methyl methacrylate | 55 | norbonyl methacrylate | 30 | diethylene glycol dimethacrylate | 15 | benzoyl peroxide 1.0 |

Example 3-2

1. Production of the Cylindrical Substrate

A polymerizable liquid substance prepared by employing formulas as described in Table 3-2 was heated and was subjected to preliminary polymerization at 40° C. for one hour to obtain an oligomer polymerizable liquid material, simulating syrup. The resulting polymerizable liquid material was well stirred and was poured into a cylindrical mold with an inner diameter of 100 mm and a length of 800 mm. While the material was brought into close contact along the inner wall employing a centrifugal force generated by rotating the mold, polymerization was carried out by heating the entire mold to 100° C. for 10 hors. The resulting substrate was subjected to an annealing treatment to room temperature at a slow rate of 0.05° C./minute, and was then taken out from the mold. The ends of the obtained substrate were cut and machined to obtain three cylindrical base bodies having an outer diameter of 100 mm and a length of 360 mm. Because the substrate taken out from the metal mold suffered slight abrasion, it was subjected buffing, and was washed and dried, and polymer Base Bodies No. 3-6 and 3-7 were obtained. Further, as a comparative example, a substrate was produced in the same manner as above, except that formula No. D was employed and the above-mentioned polymerizable liquid substance was poured into a mold without paying special attention and the annealing treatment rate was 0.2° C./minute, and a produced substrate was denoted No. 3-5.

Onto the above-mentioned cylindrical substrate, an electrical conductive layer coating composition described below was coated so as to obtain a dry thickness of 0.5 μm and the resulting coating was subjected to a thermal treatment at 80° C. for 30 minutes.

Onto the above-mentioned substrate, an interlayer (UCL) coating composition UCL-2 described below was coated so as to obtain a dry thickness of 1.0 μm.

3. UCL-2 Coating Composition

| | |
|---|---|
| Titanium chelate compound TC-750 (manufactured by Matsumoto Seiyaku Co.) | 200 g |
| Silane coupling agent KBM-503 (manufactured by Shin-Etsu Kagaku Co.) | 130 g |
| 2-Propanol | 1,000 g |

Onto the above-mentioned coated UCL, CGL layer coating composition CGL-1 described below was coated so as to obtain a dry thickness of 0.25 μm.

4. CGL-1 Coating Composition

| | |
|---|---|
| Y-type titanyl phthalocyanine (CGM-1) | 20 g |
| Silicone resin (KR-5240, manufactured by Shin-Etsu Kagaku Co.) | 40 g |
| 2-Butanone | 1,000 g |

(Composition which was obtained by dispersing the above-mentioned composition for 10 hours employing a sand mill)

Onto the above-mentioned coated CGL, a CTL layer coating composition CTL-1 described below was coated so as to obtain 25 μm and the resulting coating was subjected to a thermal treatment at 100° C. for one hour and photoreceptor drums No. 4, 5, and 6 were obtained.

5. CTL-1 Coating Composition

| | |
|---|---|
| CTM-1 | 80 g |
| Polycarbonate (Z-200, manufactured by Mitsubishi Gas Kagaku Co.) | 120 g |
| 1,2-Dichloroethane | 1,000 g |

1. Practical Image Forming Test

Each of Photoreceptor Drums No. 1 through 7 of the present invention was mounted to an inside exposure system image forming apparatus employing an electrophotographic system shown in FIG. 4 and images were formed on 50,000 sheets. Table 3-3 shows the results.

Resolution: number of fine lines per 1 mm, which can be discernible

Dimensional stability: in terms of circularity in accordance with JIS-B-0021, not less than 50 μm is represented by bad; not more than 40 μm is represented by good; and the intermediate is represented by fair.

TABLE 3-2

| Substrate No. | Formula No. | Monomer: Radical Polymerizable Monomer (weight % of entire monomers) Monomer A | Ratio | Monomer B | Ratio | Cross-linking Agent (weight % of entire monomers) Cross-linking Monomer | Ratio | Initiator (weight % of entire monomers) |
|---|---|---|---|---|---|---|---|---|
| 3-5 | D | 2-methyl-styrene | 90 | — | — | bisallyl carbonate | 10 | diisopropylperoxycarbonate 1.0 |
| 3-6 | D | methyl methacrylate | 45 | α-methyl-styrene | 45 | bisallyl carbonate | 10 | diisopropylperoxycarbonate 1.0 |
| 3-7 | E | methyl methacrylate | 70 | benzyl methacrylate | 17 | trimethylolpropane trimethylacrylate | 13 | diisopropylperoxycarbonate 1.0 |

TABLE 3-3

| Photoreceptor No. | Substrate: Double Refraction (nm) | Difference (nm) | Image Quality (A4 copy paper) | Resolution (lines/mm) | Dimensional Stability after Copying 50,000 Sheets |
|---|---|---|---|---|---|
| No. 3-1 | 160 | 55 | partial blurring | 3 in degraded area | bad |
| No. 3-2 | 25 | <5 | good from start to completing 50,000 copying | 8 | good |
| No. 3-3 | 25 | <5 | good from start to completing 50,000 copying | 8 | good |
| No. 3-4 | 25 | <5 | good from start to completing 50,000 copying | 8 | good |
| No. 3-5 | 200 | 60 | partial formation of blur | 3 in degraded area | good |
| No. 3-6 | 25 | <5 | good from start to completing 50,000 copying | 8 | good |
| No. 3-7 | 25 | <5 | good from start to completing 50,000 copying | 8 | good |

Photoreceptors Samples No. 3-2, 3-3, 3-6, and 3-7 exhibit excellent heat resistance and mechanical pushing pressure resistance during repeated use, and high stability in repetition and image characteristics are excellent.

Example 4-1

1. Production of the Cylindrical Substrate

A polymerizable liquid substance prepared by employing a mixture of a monomer material and a fire-retardant in the ratio shown in Table 4-1 below was heated and was subjected to preliminary polymerization at 40° C. for one hour to obtain an oligomer polymerizable liquid material, simulating syrup. The resulting polymerizable liquid material was poured into a cylindrical mold having an inner diameter of 100 mm and a length of 800 mm. While the material was brought into close contact along the inner wall employing a centrifugal force generated by rotating the mold, polymerization was carried out by heating the entire mold according to the temperature and time schedule of 70° C. and 8 hours, 80° C. and 8 hours, and 100° C. and 20 hours. The resulting substrate was subjected to an annealing treatment to room temperature at a rate of 0.2° C./minute, and was then taken out from the mold. The ends of the obtained substrate were cut and machined to obtain a cylindrical substrate having an outer diameter of 100 mm and a length of 360 mm. This substrate was washed and dried and transparent Base Bodies No. 4-1, through 4-7 were obtained. Examples of Fire-retardants A: antimony pentaoxide sol+P-8 (mixing ratio of 1/1)

B: antimony soda+P-11 (mixing ratio of 1/1)

C: tricresyl phosphate

D: tris(3-hydroxypropyl)phosphine oxide

E: aromatic condensed phosphoric acid ester (CR-387, manufactured by Daihachi Kagaku Co.)

F: di(polyoxyethylene)-hydroxymethyl phosphonate

G: decabromodiphenyl oxide

H: brominated polystyrene

I: hexabromocyclodecane

J: perchlorocyclopentadecane

K: ethylenebistetrabromophthalimide

L: brominated bisphenol series carbonate oligomer (Firegurad FG-7000, manufactured by Teijin Kasei Co.)

M: P-8

N: P-10

O:P-11

P: tri(bromoneopentyl)phosphate

On each of the above-mentioned these cylindrical base bodies, an electrically conductive layer coating composition described below was coated so as to obtain a dry thickness of 0.5 μm, and the resulting coating was subjected to thermal treatment at 80° C. for 30 minutes.

2. Electrically Conductive Layer Coating Composition

| | |
|---|---|
| Electrically conductive coating material X-101H manufactured by Sumitomo Kinzoku Kozan, Ltd. | 1,000 g |
| Toluene | 1,000 g |

Onto the above-mentioned substrate, as described below, an interlayer (UCL) coating composition UCL-1 was coated so as to obtain a dry thickness of 0.5 μm.

3. UCL-1 Coating Composition

| | |
|---|---|
| Copolymer nylon resin (CM-8000, manufactured by Toray Industries Inc.) | 3 g |
| Methanol/n-butanol = 10/1 (volume ratio) | 1,000 ml |

Onto the above-mentioned coated UCL, CGL layer coating composition CGL-1 described below was coated so as to obtain a dry thickness of 0.25 μm.

4. CGL-1 Coating Composition

| | |
|---|---|
| Y-type titanylphthalocyanine (CGM-1) | 20 g |
| Silicone resin (KR-5240, manufactured by Shin-Etsu Kagaku Co.) | 40 g |
| 2-Butanone | 1,000 g |

(Composition which was obtained by dispersing the above-mentioned composition for 10 hours employing a sand mill)

Onto the above-mentioned coated CGL, a CTL layer coating composition CTL-1 described below was coated so as to obtain 25 μm and the resulting coating was subjected to thermal treatment at 100° C. for one hour and Photoreceptor Drums No. 4-1 through 4-7 were obtained. Regarding the obtained base bodies, incombustibility evaluation test and light transmission measurement were carried out and the results shown in Table 1 were obtained.

| | |
|---|---|
| CTM-1 coating composition | 80 g |
| Polycarbonate (Z-200, manufactured by Mitsubishi Gas Kagaku Co.) | 120 g |
| 1,2-Dichloroethane | 1,000 g |

TABLE 4-1

| Substrate | Monomer (parts by weight) | | | | Flame Retarder parts by weight | Light | Evaluation |
|---|---|---|---|---|---|---|---|
| | Radical Polymerizable Monomer | | Cross-linking | | (to 100 of entire | Trans-mission | on Incombus- |
| No. | Monomer A | Monomer B | Monomer | Initiator | monomer) | (%) | tibility* |
| 4-1 | methyl metha-crylate 80 | α-methyl-styrene 15 | diethylene glycol dimetha-crylate 5 | benzoyl peroxide | B 20 | not less than 70% | V-0 |

TABLE 4-1-continued

| Substrate No. | Monomer (parts by weight) Radical Polymerizable Monomer Monomer A | Monomer B | Cross-linking Monomer | Initiator | Flame Retarder parts by weight (to 100 of entire monomer) | Light Trans-mission (%) | Evaluation on Incombus-tibility* |
|---|---|---|---|---|---|---|---|
| 4-2 | methyl metha-crylate 80 | α-methyl-styrene 15 | diethylene glycol dimetha-crylate 5 | benzoyl peroxide | D 30 | not less than 90% | V-0 |
| 4-3 | methyl metha-crylate 80 | α-methyl-styrene 15 | diethylene glycol dimetha-crylate 5 | benzoyl peroxide | E 40 | not less than 90% | V-0 |
| 4-4 | methyl metha-crylate 80 | α-methyl-styrene 15 | diethylene glycol dimetha-crylate 5 | benzoyl peroxide | I 20 | not less than 90% | V-0 |
| 4-5 | methyl metha-crylate 80 | α-methyl-styrene 15 | diethylene glycol dimetha-crylate 5 | benzoyl peroxide | L 25 | not less than 90% | V-0 |
| 4-6 | methyl metha-crylate 80 | α-methyl-styrene 15 | diethylene glycol dimetha-crylate 5 | benzoyl peroxide | P 30 | not less than 90% | V-0 |
| 4-7 | methyl metha-crylate 80 | α-methyl-styrene 15 | diethylene glycol dimetha-crylate 5 | benzoyl peroxide | — | not less than 90% | combustion |

*incombustibility was evaluated in accordance with UL-94 Standard

Example 4-2

1. Production of the Cylindrical Substrate

A polymerizable liquid substance prepared by employing a mixture of a monomer material and a fire-retardant in the ratio shown in Table 4-2 below was heated and was subjected to preliminary polymerization at 40° C. for one hour to obtain an oligomer polymerizable liquid material, simulating syrup. The resulting polymerizable liquid material was poured into a cylindrical mold having an inner diameter of 100 mm and a length of 800 mm. While the material was brought into close contact along the inner wall employing a centrifugal force generated by rotating the mold, polymerization was carried out by heating the entire mold according to the temperature and time schedule of 70° C. and 8 hours, 80° C. and 8 hours, and 100° C. and 20 hours. The resulting substrate was subjected to an annealing treatment to room temperature at a rate of 0.2° C./minute, and was then taken out from the mold. The ends of the obtained substrate were cut and machined to obtain a cylindrical substrate having an outer diameter of 100 mm and a length of 360 mm. This substrate was washed and dried and transparent Base Bodies No. 4-8 through 4-14 were obtained.

On each of the above-mentioned these cylindrical base bodies, an electrically conductive layer coating composition described below was coated so as to obtain a dry thickness of 0.5 μm, and the resulting coating was subjected to a thermal treatment at 80° C. for 30 minutes.

2. Electrically Conductive Layer Coating Composition

| | |
|---|---|
| Electrically conductive coating material X-101H manufactured by Sumitomo Kinzoku Kozan, Ltd. | 1,000 g |
| Toluene | 1,000 g |

Onto the above-mentioned an interlayer (UCL) coating composition UCL-2 described below was coated so as to obtain a dry thickness of 1.0 μm.

3. UCL-2 Coating Composition

| | |
|---|---|
| Titanium chelate compound TC-750 (manufactured by Matsumoto Seiyaku Co.) | 200 g |
| Silane coupling agent KBM-503 (manufactured by Shin-Etsu Kagaku Co.) | 130 g |
| 2-Propanol | 1,000 g |

Onto the above-mentioned coated UCL, a CGL layer coating composition CGL-1 described below was coated so as to obtain a dry thickness of 0.25 μm.

4. CGL-1 Coating Composition

| | |
|---|---|
| Y-type titanyl phthalocyanine (CGM-1) | 20 g |
| Silicone resin (KR-5240, manufactured by Shin-Etsu Kagaku Co.) | 40 g |
| 2-Butanone | 1,000 g |

(Composition which was obtained by dispersing the above-mentioned composition for 10 hours employing a sand mill)

Onto the above-mentioned coated CGL, a CTL layer coating composition CTL-1 described below was coated so as to obtain 25 μm and the resulting coating was subjected to a thermal treatment at 100° C. for one hour and Photoreceptor Drums No. 4-8 through 4-14 were obtained. Regarding the obtained base bodies, incombustibility evaluation test and light transmission measurement were carried out, and the results shown in Table 4-2 were obtained.

| | |
|---|---|
| CTM-1 coating composition | 80 g |
| Polycarbonate (Z-200, manufactured by Mitsubishi Gas Kagaku Co.) | 120 g |
| 1,2-Dichloroethane | 1,000 g |

a length of 800 mm. The resulting substrate was subjected to annealing treatment to room temperature and was then taken out from the mold. The ends of the obtained substrate were cut and machined. Furthermore, the substrate was subjected to buffing and was washed and dried. Cylindrical Base Bodies No. 4-15 and 4-16 having an outer diameter of 100 mm and a length of 360 mm were obtained.

Onto each of the above-mentioned cylindrical base bodies, an electrically conductive layer, an interlayer, a CGL layer, and a CTL layer were coated and Photoreceptor Drums No. 4-15 and 4-16 were obtained.

Comparative example of a substrate was produced in the same manner as Example 3, except that no fire-retardant was incorporated. This Comparative Substrate was denoted No. 4-17 and the obtained Photoreceptor Drum was denoted No. 4-17.

TABLE 4-2

| Substrate | Monomer (parts by weight) Radical Polymerizable Monomer | | Cross-linking | | Flame Retarder parts by weight | Light | Evaluation |
|---|---|---|---|---|---|---|---|
| No. | Monomer A | Monomer B | Monomer | Initiator | (to 100 of entire monomer) | Trans-mission (%) | on Incombus-tibility* |
| 4-8 | methyl metha-crylate 70 | benzyl metha-crylate 17 | trimethylol propane trimetha-crylate 13 | azo-isobutylo-nitrile | F 20 | not less than 90% | V-0 |
| 4-9 | methyl metha-crylate 70 | benzyl metha-crylate 17 | triethylol propane trimetha-crylate 13 | azo-isobutylo-nitile | K 30 | not less than 90% | V-0 |
| 4-10 | methyl metha-crylate 70 | benzyl metha-crylate 17 | trimethylol propane trimetha-crylate 13 | azo-isobutylo-nitile | M 40 | not less than 90% | V-0 |
| 4-11 | methyl metha-crylate 70 | benzyl metha-crylate 17 | trimethylol propane trimetha-crylate 13 | azo-isobutylo-nitile | N 20 | not less than 90% | V-0 |
| 4-12 | methyl metha-crylate 70 | benzyl metha-crylate 17 | trimethylol propane trimetha-crylate 13 | azo-isobutylo-nitile | O 20 | not less than 90% | V-0 |
| 4-13 | methyl metha-crylate 70 | benzyl metha-crylate 17 | trimethylol propane trimetha-crylate 13 | azo-isobutylo-nitile | P 25 | not less than 90% | V-0 |
| 4-14 | methyl metha-crylate 70 | benzyl metha-crylate 17 | trimethylol propane trimetha-crylate 13 | azo-isobutylo-nitile | — | not less than 90% | combusted |

*incombustibility was evaluated in accordance with UL-94 Standard

Example 4-3

1. Production of the Cylindrical Substrate

A mixture prepared by mixing polycarbonates and fire-retardants in the mixing ratio described in Table 4-3 was subjected to ejection molding under conditions of a cylinder temperature of 300° C., an ejection pressure of 1,100 kg/cm$^2$, and a metal mold temperature of 150° C. and a cylindrical substrate with an inner diameter of 100 mm and

TABLE 4-3

| Substrate No. | Fire-retardant part by weight (to 100 of entire monomers) | Light Transmission (%) | Evaluation on Incombustibility |
|---|---|---|---|
| 4-15 | E 20 | not less than 85% | V-0 |
| 4-16 | L 30 | not less than 85% | V-0 |
| 4-17 | — | not less than 85% | combustion |

2. Practical Image Forming Test

Each of Photoreceptor Drums No. 4-1 through 4-17 of the present invention was mounted to an interior exposure system image forming apparatus employing an electrophotographic system shown in FIG. 4 and images were formed on 50,000 sheets. Table 4-4 shows the results together with those of incombustibility test. The resolution of the image on the 50,000th sheet shows the number of lines per mm which can be identified and image quality is evaluated by observing a finished image (A4).

TABLE 4-4

| Photo-receptor No. | Image Quality (A4 copy paper) | Resolution (lines/mm) | Evaluation on Incombus-tibility |
|---|---|---|---|
| 4-1 | good from start to completion of copying 50,000 sheets | approximately 8 | V-0 |
| 4-2 | good from start to completion of copying 50,000 sheets | approximately 8 | V-0 |
| 4-3 | good from start to completion of copying 50,000 sheets | approximately 8 | V-0 |
| 4-4 | good from start to completion of copying 50,000 sheets | approximately 8 | V-0 |
| 4-5 | good from start to completion of copying 50,000 sheets | approximately 8 | V-0 |
| 4-6 | good from start to completion of copying 50,000 sheets | approximately 8 | V-0 |
| 4-7 | formation of image defects due to scar from start | approximately 5 in some areas | combustion |
| 4-8 | good from start to completion of copying 50,000 sheets | approximately 8 | V-0 |
| 4-9 | good from start to completion of copying 50,000 sheets | approximately 8 | V-0 |
| 4-10 | good from start to completion of copying 50,000 sheets | approximately 8 | V-0 |
| 4-11 | good from start to completion of copying 50,000 sheets | approximately 8 | V-0 |
| 4-12 | good from start to completion of copying 50,000 sheets | approximately 8 | V-0 |
| 4-13 | good from start to completion of copying 50,000 sheets | approximately 8 | V-0 |
| 4-14 | formation of image defects due to scar from start | approximately 5 in some areas | combustion |
| 4-15 | good from start to completion of copying 50,000 sheets | approximately 8 | V-0 |
| 4-16 | good from start to completion of copying 50,000 sheets | approximately 8 | V-0 |
| 4-17 | formation of image defects due to scar from start | approximately 5 in some areas | combustion |

By employing substrate samples 4-1 through 4-6, 4-8 through 4-13, and 4-16 and 4-16, photoreceptors were obtained which exhibited an incombustibility of V-0 class in the UL-94 Specification, excellent transparency, caused no scar defects such as contusion, abrasion, fine cracking, etc., formed no image defects, exhibited high heat resistance and mechanical pushing pressure resistance during repeated use, and exhibited high stability in repetition.

The present invention can provide a transparent substrate for an electrophotographic photoreceptor, which minimizes image blurring and image distortion when an image is exposed through the photoreceptor substrate, results in good adhesion of the substrate to the electrically conductive layer, exhibits excellent resolving power of finished images, excellent durability properties, and a production method thereof, and an electrophotographic photoreceptor, an image forming method, and an image forming apparatus using the same.

What is claimed is:

1. A transparent substrate for the electrophotographic photoreceptor which is cylindrical and made of a polymer resin, wherein Rz of an inner surface of the cylindrical substrate is not more than 0.5 $\mu$m, Rz is the average roughness at ten points calculated from the difference between the average height of five summits and the average depth of five valleys.

2. The transparent substrate of claim 1, wherein Rz of an outer surface of the cylindrical transparent substrate is 0.2 to 2.0 $\mu$m.

3. The transparent substrate of claim 1, wherein the polymer resin is vinyl polymer resin.

4. The transparent substrate of claim 1, wherein waviness of the inner surface of the cylindrical transparent substrate is 0.1 to 5.0 $\mu$m.

5. The transparent substrate of claim 1, wherein the transparent substrate is formed of a polymer resin obtained by copolymerizing radical polymerizable monomers using a multifunctional vinyl compound.

6. The transparent substrate of claim 5, wherein radical polymerizable monomer is methyl methacrylate.

7. The transparent substrate of claim 1, wherein, double refraction of the transparent substrate is not more than 150 nm and the difference of the double refraction in the substrate is within 50 nm.

8. The transparent substrate of claim 1, wherein the transparent substrate is formed of a polymer resin containing a fire-retardant.

9. The transparent substrate of claim 1, wherein the transparent substrate is formed of a polymer resin obtained by a centrifugal polymerization method.

10. An electrophotographic photoreceptor having an electrically conductive layer and a photosensitive layer onto the transparent substrate of claim 1.

11. An image forming method comprising uniformly charging surface of the electrophotographic photoreceptor of claim 10, exposing imagewise the electrophotographic photoreceptor, developing repeatedly carried out with each toner having different color to form superimposed multicolor toner images, transferring the multicolor images simultaneously on a image forming sheet, separating the image forming sheet from the electrophotographic photoreceptor, fixing the multicolor toner images, and the photoreceptor is cleaned.

12. The image forming method of claim 11, wherein the exposing imagewise the electrophotographic photoreceptor from the inside of the cylindrical substrate of the photoreceptor.

13. The image forming method of claim 11, wherein the developing is carried out by means of non-contact development.

* * * * *